US009793663B2

(12) United States Patent
Poulsen et al.

(10) Patent No.: US 9,793,663 B2
(45) Date of Patent: Oct. 17, 2017

(54) COMMUNICATION CONNECTORS HAVING SWITCHABLE ELECTRICAL PERFORMANCE CHARACTERISTICS

(71) Applicant: Leviton Manufacturing Co., Inc., Melville, NY (US)

(72) Inventors: Jeffrey Alan Poulsen, Lynnwood, WA (US); Gregory Hammond, Edmonds, WA (US); Jon Clark Riley, Redmond, WA (US); Franklin Conrad Marti, Clinton, WA (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 0 days.

(21) Appl. No.: 15/013,722

(22) Filed: Feb. 2, 2016

(65) Prior Publication Data

US 2016/0149352 A1 May 26, 2016

Related U.S. Application Data

(63) Continuation of application No. 14/206,553, filed on Mar. 12, 2014, now Pat. No. 9,413,121.

(Continued)

(51) Int. Cl.
*H01R 29/00* (2006.01)
*H01R 24/64* (2011.01)

(Continued)

(52) U.S. Cl.
CPC ..... *H01R 24/64* (2013.01); *H01R 13/659* (2013.01); *H01R 13/6658* (2013.01);

(Continued)

(58) Field of Classification Search
CPC .. H01R 12/7094; H01R 13/641; H01R 13/70; H01R 13/703; H01R 13/713; H01R 13/7039; H01R 24/46

(Continued)

(56) References Cited

U.S. PATENT DOCUMENTS 6,007,368 A 12/1999 Lorenz et al.
6,017,237 A * 1/2000 Sullivan ..... H01R 43/01 439/392

(Continued)

OTHER PUBLICATIONS

Notice of Allowance, dated Apr. 5, 2016, received in U.S. Appl. No. 14/206,553.

*Primary Examiner* — Abdullah Riyami
*Assistant Examiner* — Thang Nguyen
(74) *Attorney, Agent, or Firm* — Davis Wright Tremaine LLP; George C. Rondeau, Jr.; Heather M. Colburn

(57) ABSTRACT

A connector configured to operate in two different electrical performance modes. The connector may include a plurality of connector contacts, a plurality of contact pads, and an insulator having an insulating portion adjacent the plurality of contact pads. The insulator is movable between an insulating position and a non-insulating position. When the insulator is in the insulating position, the insulating portion insulates the plurality of contact pads from the plurality of connector contacts and the connector operates in a first one of the electrical performance modes. When the insulator is in the non-insulating position, the plurality of connector contacts contact the plurality of contact pads and the connector operates in a different second one of the electrical performance modes. The connector may be implemented as a plug or an outlet.

28 Claims, 32 Drawing Sheets

Related U.S. Application Data

(60) Provisional application No. 61/779,838, filed on Mar. 13, 2013.

(51) Int. Cl.
*H01R 13/659* (2011.01)
*H01R 13/70* (2006.01)
*H01R 13/66* (2006.01)
*H01R 13/71* (2006.01)

(52) U.S. Cl.
CPC ..... *H01R 13/70* (2013.01); *H01R 13/71* (2013.01); *H01R 29/00* (2013.01)

(58) Field of Classification Search
USPC ..... 439/188, 344, 941, 676
See application file for complete search history.

(56) References Cited

U.S. PATENT DOCUMENTS 6,056,568 A 5/2000 Arnett
6,074,256 A 6/2000 Arnett
6,079,996 A * 6/2000 Arnett ..... H01R 24/64 200/51.06
6,109,943 A 8/2000 Arnett
6,139,343 A 10/2000 Arnett
6,162,077 A * 12/2000 Laes ..... H01R 13/7032 439/188
6,168,472 B1 1/2001 Arnett
7,837,513 B2 11/2010 Millette et al.
8,715,013 B2 5/2014 Caveney et al.
8,858,266 B2 * 10/2014 Robinson ..... H01R 13/646 439/607.38
9,112,320 B2 * 8/2015 Hashim ..... H01R 13/6466
9,520,676 B1 * 12/2016 Chen ..... H01R 29/00
2005/0181676 A1 8/2005 Caveney et al.
2011/0115494 A1 5/2011 Taylor et al.
2012/0282818 A1 11/2012 Caveney et al.
2013/0210277 A1 8/2013 Robinson
2015/0056824 A1 * 2/2015 Bolouri-Saransar ..... H01R 4/24 439/64

* cited by examiner

COMMUNICATION CONNECTORS HAVING SWITCHABLE ELECTRICAL PERFORMANCE CHARACTERISTICS

CROSS-REFERENCE TO RELATED APPLICATION(S)

This application is a continuation of U.S. patent application Ser. No. 14/206,553, filed on Mar. 12, 2014, which claims the benefit of U.S. Provisional Application No. 61/779,838, titled Communication Connectors Having Switchable Electrical Performance Characteristics, filed on Mar. 13, 2013, which is incorporated herein by reference in its entirety.

BACKGROUND OF THE INVENTION

Field of the Invention

The present invention is directed generally to communications connectors, and more particularly to registered jack 45 ("RJ-45") type connectors.

Description of the Related Art

Standards committees are in the process of developing specifications for a Next Generation ("Next Gen") Data Transmission System that will provide data rates of approximately 40 gigabit per second (sometimes abbreviated as "40G") over a distance of approximately 40 meters using twisted pair copper cables. The system will consist of electronic transceiver devices and structured cabling. Requirements for the transceiver devices will be specified by one standards committee while the structured cabling requirements will be specified by others. The standards committees involved coordinate with each other during the standards development process to provide a reliable, cost effective transmission system.

The structured cabling connects between two of the transceivers and is used as the medium to carry data back and forth between the two devices. Structured cabling consists of cable, patch cordage and connectors which will be interconnected to form channels. It is likely that Next Gen channels will consist of a maximum number of two, and possibly less, connector interfaces. Each connector interface consists generally of an outlet (sometimes referred to as a "jack") and a plug. Thus the channels and their components, along with the electronic transceivers, must be configured to work together to be able to deliver the specified data through-put up to the specified distance.

This application discloses structured cabling, more specifically, the connectors used in a structured cabling system. The specification and operation of the electronic transceiver devices that may be used in association with the connectors and structured cabling disclosed in this application are understood by those of ordinary skill in the art to be used pursuant to specifications ensuring the individual components of such a system work together to deliver the desired overall system performance.

Such a system will likely operate over a frequency range of up to about 2 gigahertz ("GHz"). Some key requirements for the structured cabling portion of the system (also referred to as "channels") will include return loss ("RL"), insertion loss ("IL"), near end crosstalk ("NEXT") and power sum alien crosstalk ("PSANEXT"). Components of the channel (e.g. cable, patch cordage and connectors) will each have corresponding requirements for these key parameters as well as a considerable number of other specified parameters. It is likely that the nomenclature used to refer to the Next Gen of cabling will be "Category 8" which is in line with the naming of its predecessors (e.g., Categories 1, 2, 3, 4, 5, 5e, 6, and 6A).

Next Gen cabling will likely include cables and patch cordage similar to existing Category 6A unshielded twisted pair ("UTP") cables and patch cordage, however, their designs will be modified somewhat to enable them to meet the electrical requirements for Next Gen. It is likely that an overall shield will be added to enable the cables and patch cordage to meet the PSANEXT requirements specified for Next Gen cables.

Similarly Next Gen cabling will likely include RJ-45 type connectors (outlets and plugs) that are similar to existing Category 6A connectors, however, their designs will be modified somewhat to enable them to meet the electrical requirements for Next Gen. As with the cables, it is likely that an overall shield will be added to the plug and outlets to enable them to meet the PSANEXT requirements specific for Next Gen connectors.

One standards committee, the Telecommunication Industry Association ("TIA") TR-42.7 subcommittee, is considering enhancing the performance of RJ-45 type connectors such that they will meet all the electrical requirements for the Next Gen standard up to the highest frequencies specified. RJ-45 type connectors include a plug and an outlet configured to be connected together to form a mated connection or mated connector.

It is interesting to note that when RJ-45 connector technology was first developed in the mid 1970's at operating frequencies for use with voice transmissions in telephone technologies, it was thought that someday RJ-45 connectors may be used for operating frequencies of up to about 2 megahertz ("MHz"), which is 1000 times less than the operating frequency (2 GHz) required by the Next Gen standard.

RJ-45 type connectors have some inherent transmission performance issues, the root of which lies in the geometry of the spade contacts used in the plug and the manner in which these contacts are assigned to specific conductors of specific pairs. The plug's geometry creates substantial levels of transmission impairment in the form of crosstalk and, to a lesser extent, RL. Over the years, despite increased performance demands on the RJ-45 technology, engineers have managed to overcome these performance issues caused by the plug through the application of certain compensation schemes and transmission enhancing techniques in the outlet. Such designs enable the industry to continue to use the same general form factor of plug and outlet and maintain the mechanically and electrically backwards compatibility of new product to existing product.

Other types of connector technology have also been proposed but are mechanically incompatible with the RJ-45 type connector form factor. Given the general low cost of RJ-45 technology, and its wide spread proliferation over the years, the industry has generally stayed with the RJ-45 type connector for transmission speeds up to, and including, 10 gigabits per second ("10G"). Now, however, as the industry begins to look to 40 gigabits per second transmission rates using copper cabling, some question the ability of the RJ-45 type connector to perform well enough for Next Gen applications.

To date, at least one manufacturer has proposed a design that enables RJ-45 type connectors to perform at up to about 2 GHz. This design uses some unique electrical techniques in the plug to accomplish compensation at higher frequencies. Such solutions, however, though largely backwards compatible with existing product, still have the same inherent transmission performance issues of the original plug. To date, results have shown fair performance but, in order to be effective, the plug has so far been used solely with just one manufacturer's proprietary outlet which utilizes a unique tine design.

Therefore, a need exists for new connectors configured to perform in accordance with new standards (e.g., the Next Gen or Category 8 standard) but maintain backwards compatibility with connectors constructed pursuant to other standards (e.g., Categories 1, 2, 3, 4, 5, 5e, 6 and 6A). In addition, it would be desirable that the design of any such connector be more universally compatible with existing outlet designs and the tine structures that manufacturers typically employ. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 1A:
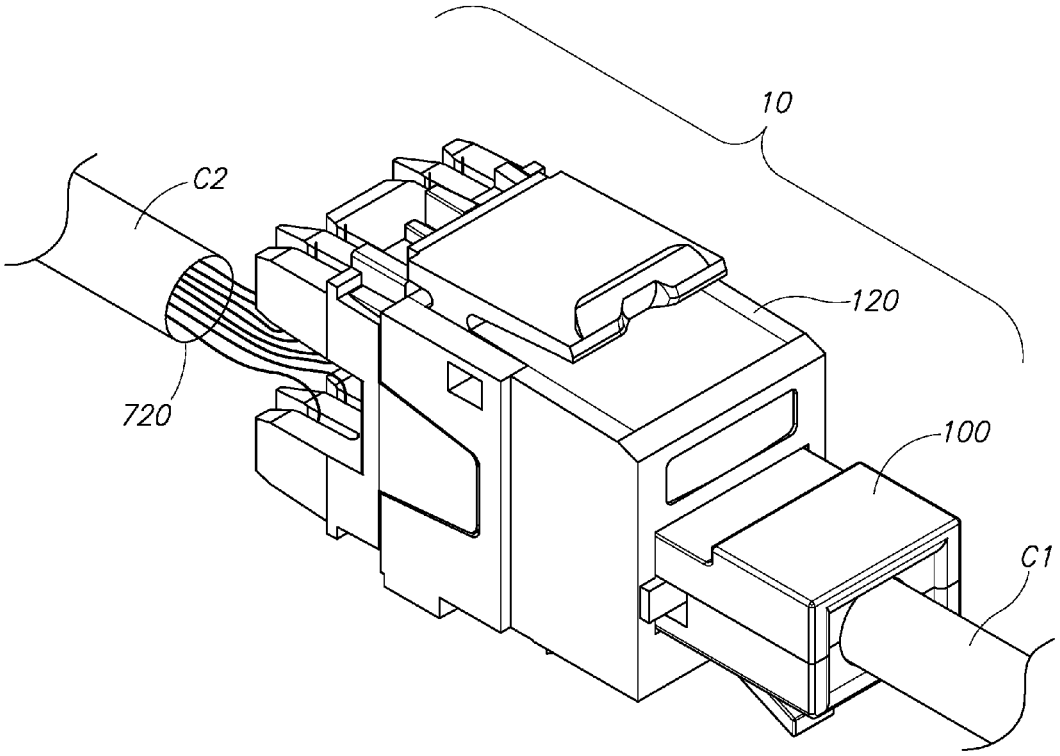
FIG. 1A is a perspective view of a connection formed by a plug and an outlet.

As mentioned above, the Next Gen cabling standard is under development and will likely be referred to as Category 8. At present, some aspects of the cabling standard have been roughly determined. For example, the standard specifies an approximate operating frequency range of up to 2 GHz and a maximum channel length of up to approximately 40 meters. The standard also specifies approximate values for electrical parameters that Next Gen channels must meet. Some key electrical parameters specified include RL, IL, NEXT and PSANEXT. Table A (below) lists approximate values for these parameters at various key frequencies.

TABLE A

| Parameter (Approximate Frequency) | 100 MHz | 500 MHz | 2 GHz |
|---|---|---|---|
| RL (dB) | 12 | 8 | 6 |
| IL (dB) | 10 | 24 | 54 |
| NEXT (dB) | 40 | 26 | 10 |
| PSANEXT (dB) | 75 | 70 | 60 |

It is understood by those of ordinary skill in the art that these values could change as the standard solidifies but they are the approximate values presently under consideration.

These channel parameters are met by assigning corresponding values to the same parameter for the components that make up the channel, e.g. cable, patch cordage and mated connectors. Since connectors are the focus of this application, parameters for cable and patch cordage will not be discussed, however, it is understood by those of ordinary skill in the art that the values specified for the cable and patch cordage have been selected to meet the channel requirements when used in conjunction with the connectors.

Table B herein lists approximate values for these electrical parameters at various key frequencies as applied to mated connectors.

TABLE B

| Mated Connector Electrical Requirements | | | |
|---|---|---|---|
| Parameter | 100 MHz | 500 MHz | 2 GHz |
| RL (dB) | 30 | 16 | 8 |
| IL (dB) | 0.2 | 0.5 | 3 |
| NEXT (dB) | 54 | 37 | 13 |
| PSNEXT (dB) | 84 | 77 | 64 |

It is understood by those of ordinary skill in the art that these values could change as the standard solidifies but they are the approximate values presently under consideration.

As used herein, the term "legacy" refers to earlier standards used to construct existing "conventional" RJ-45 type connectors. Such legacy standards include, but are not limited to, Categories 1, 2, 3, 4, 5, 5e, 6 and 6A. The term "legacy" will be used herein to refer to the legacy electrical performance modes of operation of the disclosed Next Gen outlet and plug when used in association with conventional outlets and plugs. The term "conventional" will be used herein to refer to existing plugs or outlets that meet these legacy standard requirements (e.g. Categories 1, 2, 3, 4, 5, 5e, 6, and 6A) which have so far been specified as being backwards compatible to all lower category products.

Values specified for connectors (and cables/patch cordage), have been selected for the Next Gen standard so as to be backward compatible with corresponding conventional components. As such, Next Gen cabling products can be used interchangeably with conventional products. In regards to the connectors (outlets and plugs), this applies as long as the physical interface of the connectors for Next Gen remain compatible with the existing conventional RJ-45 standards.

It should be noted that Category 6A products are specified to 500 MHz and as such the values specified in the tables herein for Next Gen mated connectors at or below 500 MHz meet or exceed the values specified by Category 6A and all lower Categories.

FIG. 1A depicts an assembly or connection 10 that includes a plug 100 mated with an outlet 120. The plug 100 and the outlet 120 are each RJ-45 type connectors. The plug 100 terminates a communication cable C1 and the outlet 120 terminates a communication cable C2. The connection 10 connects the cables C1 and C2 together.

Figure 1B:
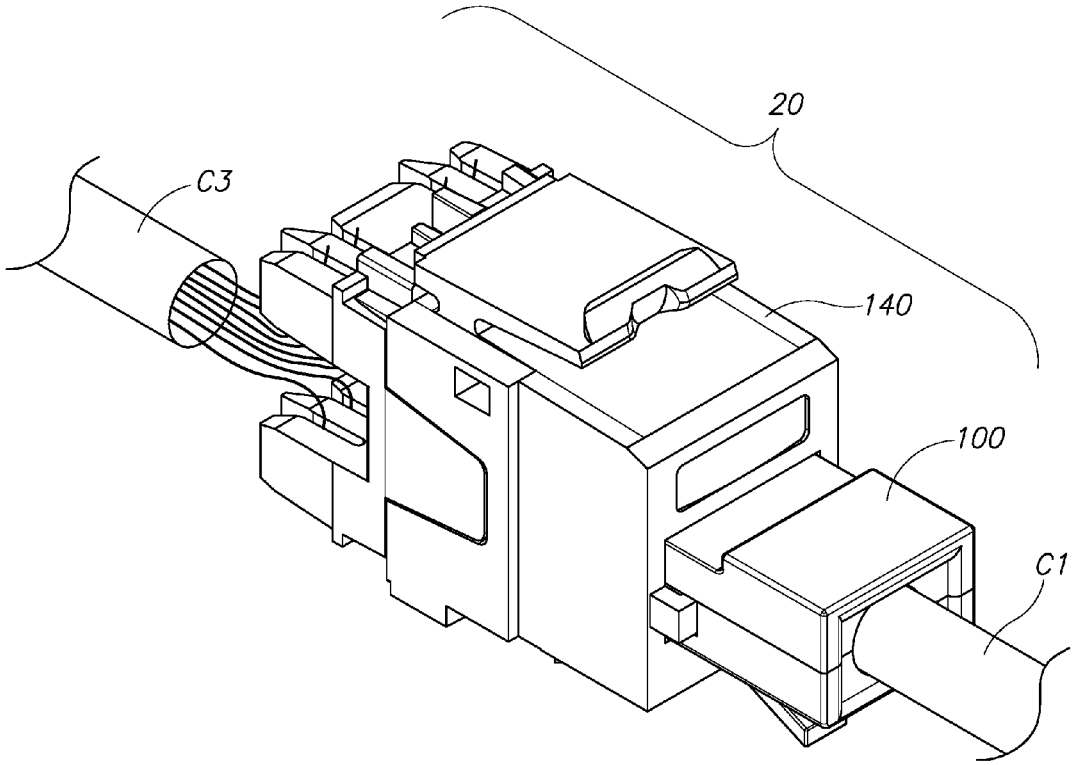
FIG. 1B is a perspective view of a connection formed by the plug of FIG. 1A and a conventional outlet.

FIG. 1B depicts an assembly or connection 20 that includes the plug 100 mated with a conventional RJ-45 type outlet 140. Thus, the plug 100 is backward compatible with conventional outlets. The plug 100 terminates the cable C1 and the conventional outlet 140 terminates a communication cable C3. Thus, the connection 20 connects the cables C1 and C3 together.

Figure 1C:
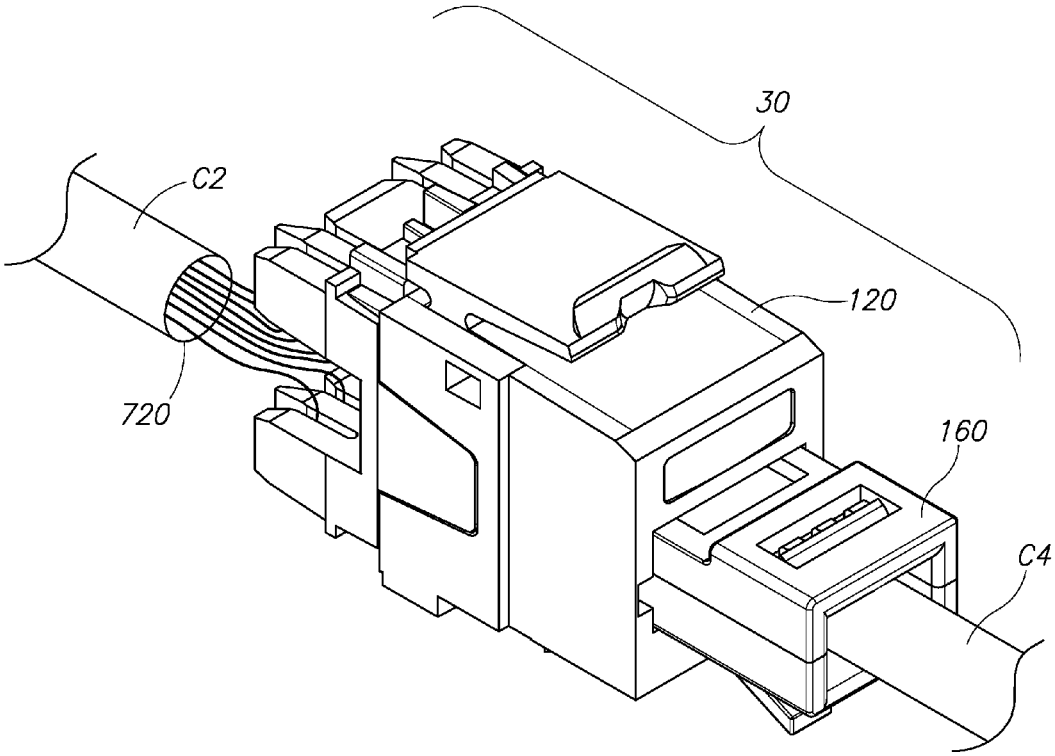
FIG. 1C is a perspective view of a connection formed by the outlet of FIG. 1A and a conventional plug.

FIG. 1C depicts an assembly or connection 30 that includes a conventional RJ-45 type plug 160 mated with the outlet 120. Thus, the outlet 120 is backward compatible with conventional plugs. The outlet 120 terminates the cable C2 and the conventional plug 160 terminates a conventional communication cable C4. Thus, the connection 30 connects the cables C2 and C4 together.

The cables C1, C2, C3, and C4 may be substantially identical to one another. For the sake of brevity, only the structure of the cable C1 will be described in detail. It is assumed that all cables have been designed and constructed in such a fashion as to meet all the electrical performance requirements of a Next Gen/Category 8 communications cable.

Figure 5A:
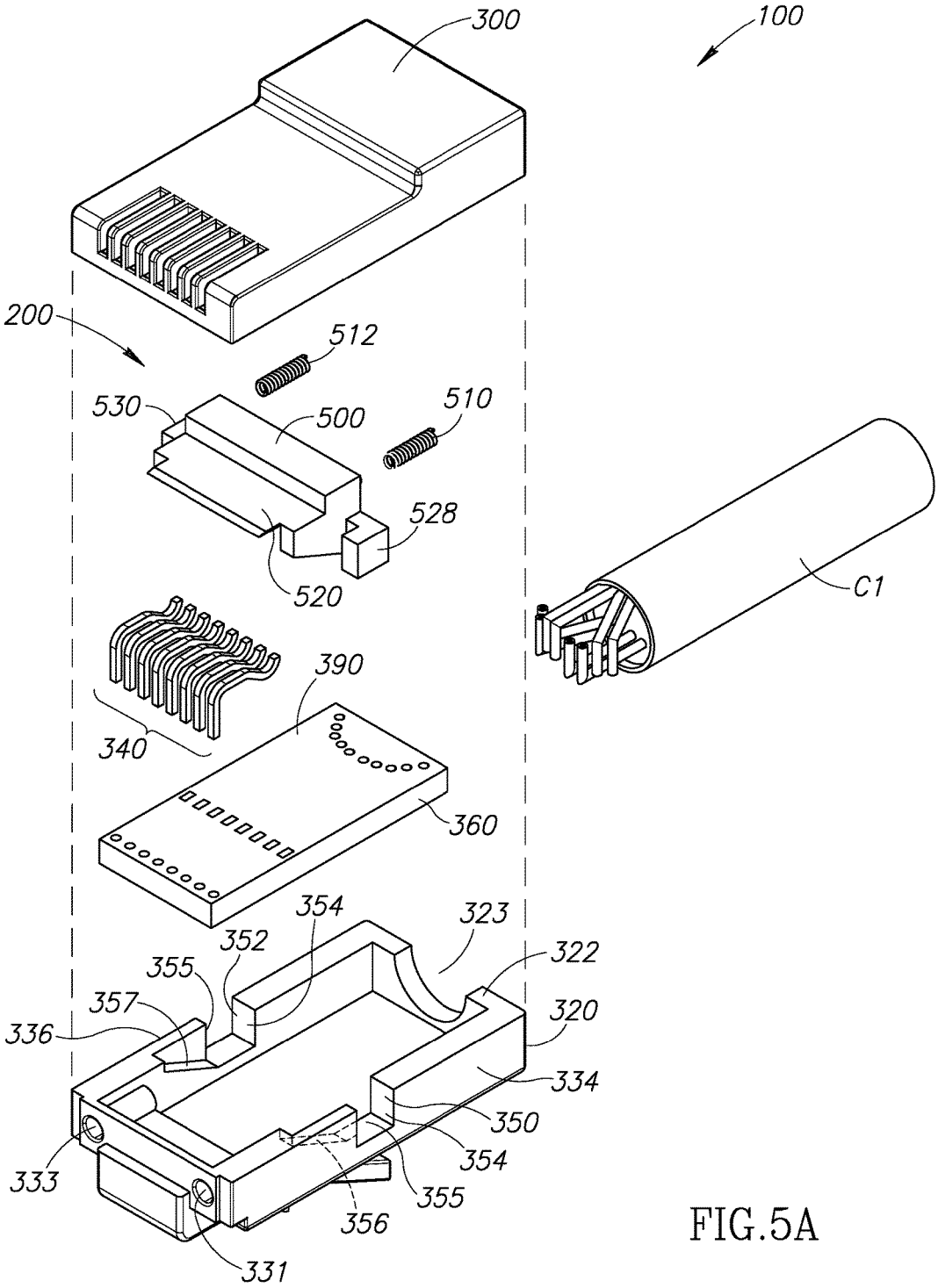
FIG. 5A is an exploded perspective view of the plug of FIG. 1A taken from above the plug.
Figure 5B:
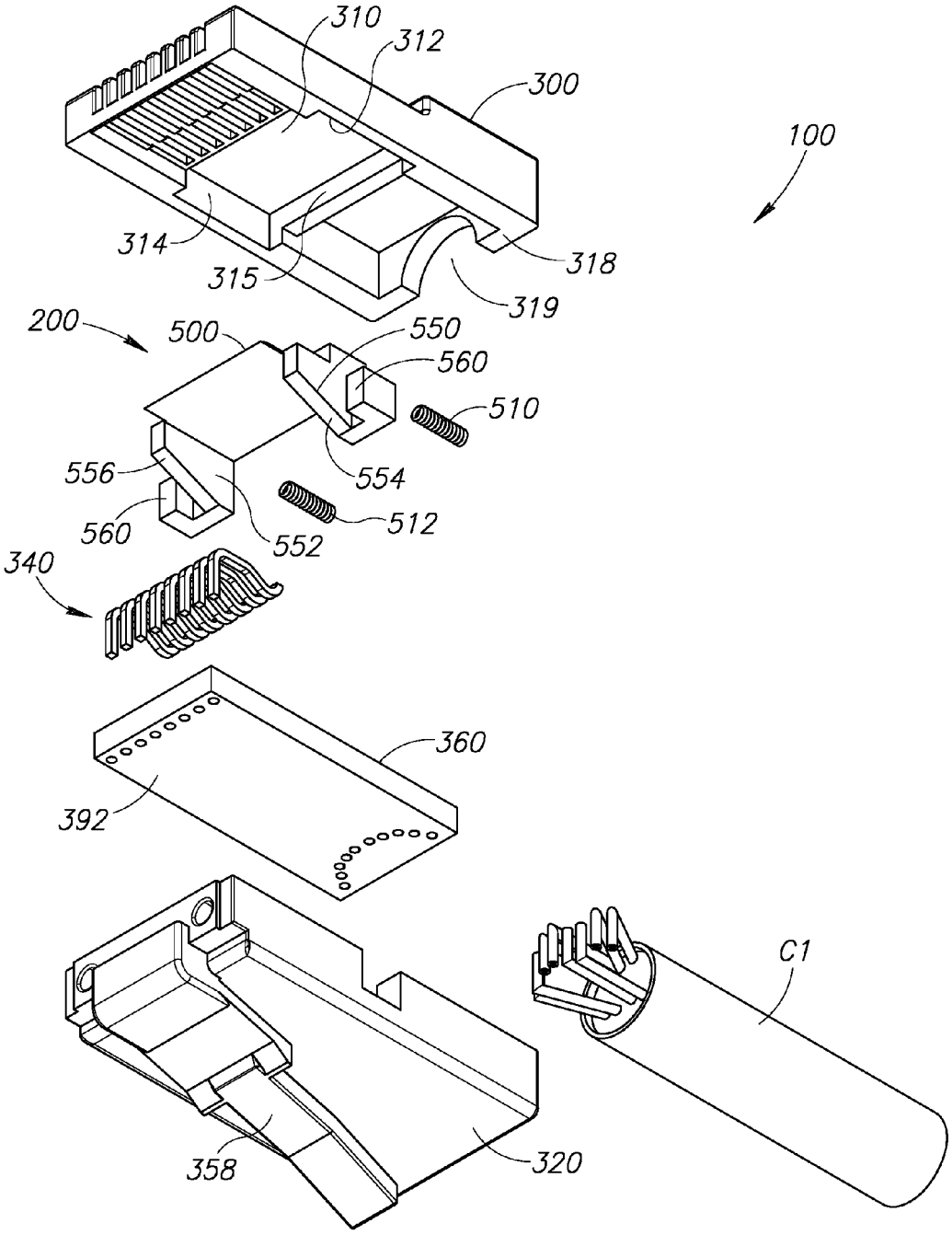
FIG. 5B is an exploded perspective view of the plug of FIG. 1A taken from below the plug.
Figure 5C:
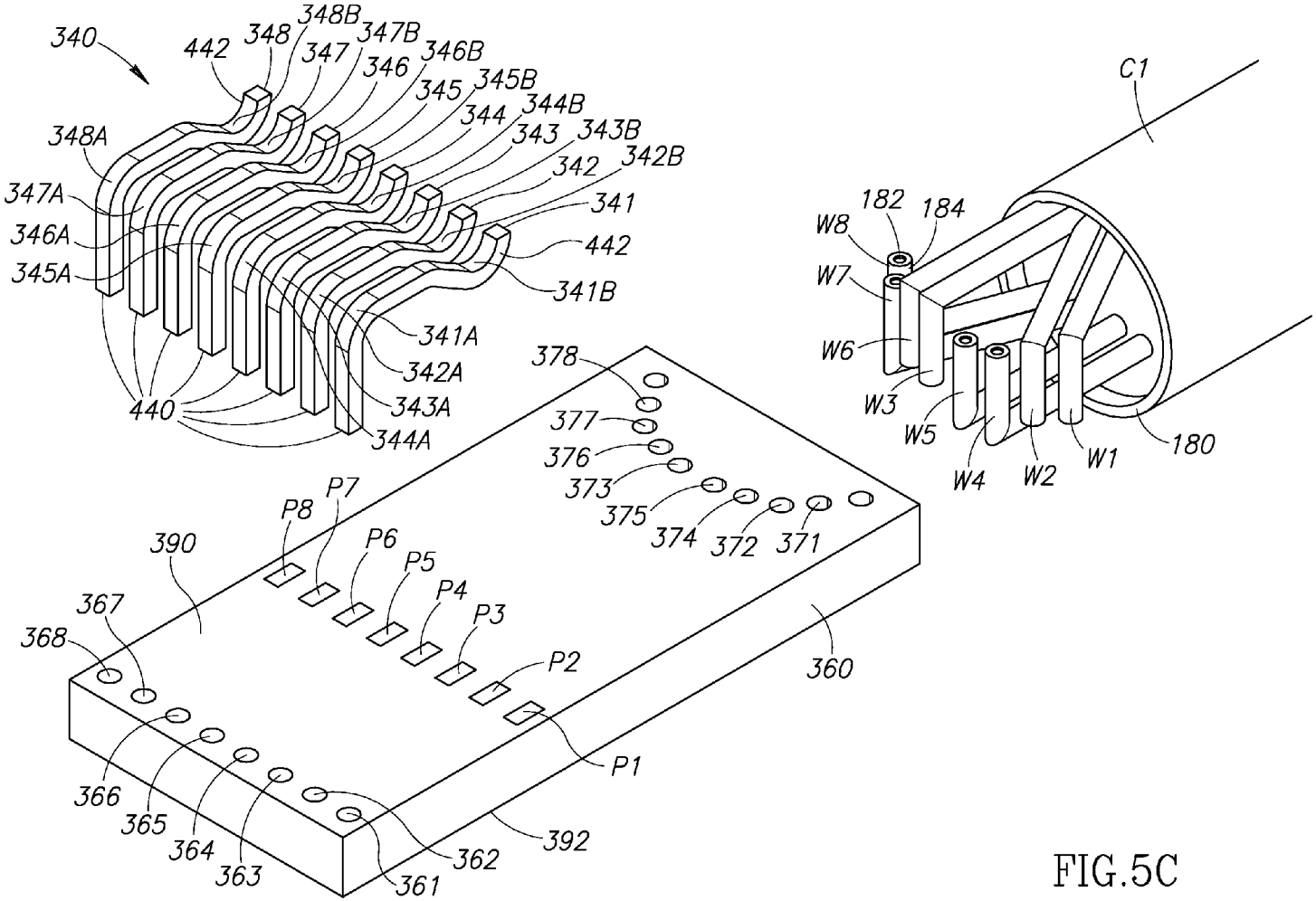
FIG. 5C is an enlargement of a portion of FIG. 5A.

Turning to FIG. 5C, the cable C1 includes a plurality of wires W1-W8 arranged in four twisted-wire pairs (also known as "twisted pairs"). The first twisted pair includes the wires W4 and W5. The second twisted pair includes the wires W1 and W2. The third twisted pair includes the wires W3 and W6. The fourth twisted pair includes the wires W7 and W8. The wires W1-W8 are housed inside an outer cable sheath 180 typically constructed from an electrically insulating material.

Each of the wires W1-W8 is substantially identical to one another. For the sake of brevity, only the structure of the wire W1 will be described. As is appreciated by those of ordinary skill in the art, the wire W1 as well as the wires W2-W8 each includes an electrical conductor 182 (e.g., a conventional copper wire) surrounded by an outer layer of insulation 184 (e.g., a conventional insulating flexible plastic jacket).

Each of the twisted pairs serves as a conductor of a differential signaling pair wherein signals are transmitted thereupon and expressed as voltage and/or current differences between the wires of the twisted pair. A twisted pair can be susceptible to electromagnetic sources including another nearby cable of similar construction. Signals received by the twisted pair from such electromagnetic sources external to the cable's jacket are referred to as alien crosstalk. The twisted pair can also receive signals from one or more wires of the three other twisted pairs within the cable's jacket, which is referred to as "local crosstalk" or "internal crosstalk."

The plug 100 and the outlet 120 are each configured to be switchable between a first mode of operation and a second mode of operation. In the embodiments illustrated, the first mode may be characterized as being the Next Gen mode (e.g. Connection 10 including a Next Gen outlet and a Next Gen plug), and the second mode may be characterized as being the legacy mode (e.g. Connection 20 or Connection 30 including a Conventional outlet and Next Gen plug or a Next Gen outlet and a Conventional plug, respectively).

In the first or Next Gen mode, the plug 100 and the outlet 120 are each configured to operate such that when mated together, their mated performance conforms to the electrical requirements given in Table B, in addition to all other applicable electrical requirements specified by the Next Gen specification. Thus, when operating in the first (Next Gen) mode, the plug 100 and the outlet 120 may each be mated with other similar performing RJ-45 type connectors, and when so mated, perform in accordance with the Next Gen standard. The plug 100 and the outlet 120 are both illustrated operating in the first mode in FIG. 1A.

On the other hand, the plug 100 and the outlet 120 may each be mated with conventional RJ-45 type connectors. When configured as such, the plug 100 and outlet 120 will then operate in the second (legacy) mode at which time the mated performance of the plug and outlet will conform to mated performance requirements given in earlier specifications. The level of this mated performance will be dictated by the performance level of the connector with which plug 100 or outlet 120 is mated. For example, if outlet 120 is mated with a Category 6 plug, the mated performance of this combination of connectors will conform to the mated performance requirements specified by Category 6. Similarly, if plug 100 is mated with a Category 6 outlet, the mated performance of this combination of connectors will conform to the mated performance requirements specified by Category 6.

Thus, the plug 100 and the outlet 120 are each backward compatible with hardware constructed according to earlier standards that use RJ-45 type connectors. The plug 100 is illustrated operating in the second mode in FIG. 1B and the outlet 120 is illustrated operating in the second mode in FIG. 1C.

While the general intent is for the plug 100 and outlet 120 to be implemented with each having the capability of operating in both a legacy and Next Gen mode, and having the capability of being freely switched from one mode of operation to the other, it is not mandatory that either the plug 100 or 120 be implemented as such. Rather the plug 100 may optionally be implemented to operate permanently or semi-permanently in either the legacy or Next Gen mode and, similarly, the outlet 120 may optionally be implemented to operate permanently or semi-permanently in either the legacy or Next Gen mode.

In addition, while the plug 100 when operating in the legacy mode (either implemented with the capability of being switched freely or not) is intended to be used with outlets conforming to legacy electrical performance modes of operation, this is not mandatory and it may be used along with any other outlet conforming to any other requirements as long as the outlet is mechanically compatible with plug 100. However when used as such the mated performance of the plug 100 operating in the legacy mode and the outlet in question will be undefined and dependent on the implementation and performance of the outlet with which it is mated.

Similarly, while the outlet 120 when operating in the legacy mode (either implemented with the capability of being switched freely or not) is intended to be used with plugs conforming to legacy electrical performance modes of operation, this is not mandatory and can be used along with any other plug conforming to any other requirements as long as the plug is mechanically compatible with outlet 120. However when used as such the mated performance of the outlet 120 operating in the legacy mode and the plug in question will be undefined and dependent on the implementation and performance of the plug with which it is mated.

Turning to FIGS. 2A-3D, the plug 100 includes a mechanical switch 200 that switches the mode of operation of the plug between the first and second electrical performance modes of operation. The plug 100 is configured to operate in the first Next Gen mode in FIGS. 2A-2C. The plug 100 is configured to operate in the second legacy mode in FIGS. 3A-3D. The switch 200 is configured to be automatically transitioned from the first mode (see FIGS. 2A-2C) to the second mode (see FIGS. 3A-3D) when the plug 100 is mated with an outlet (e.g., the conventional outlet 140 illustrated in FIG. 1B) other than the outlet 120. The switch 200 is further configured to remain in the first mode when the plug 100 is mated with the outlet 120. As explained in detail below, the switch 200 may be transitioned between the first and second modes by features present (or absent) in outlets other than the outlet 120, features present (or absent) in the outlet 120, and/or features present (or absent) in the plug 100.

Figure 4A:
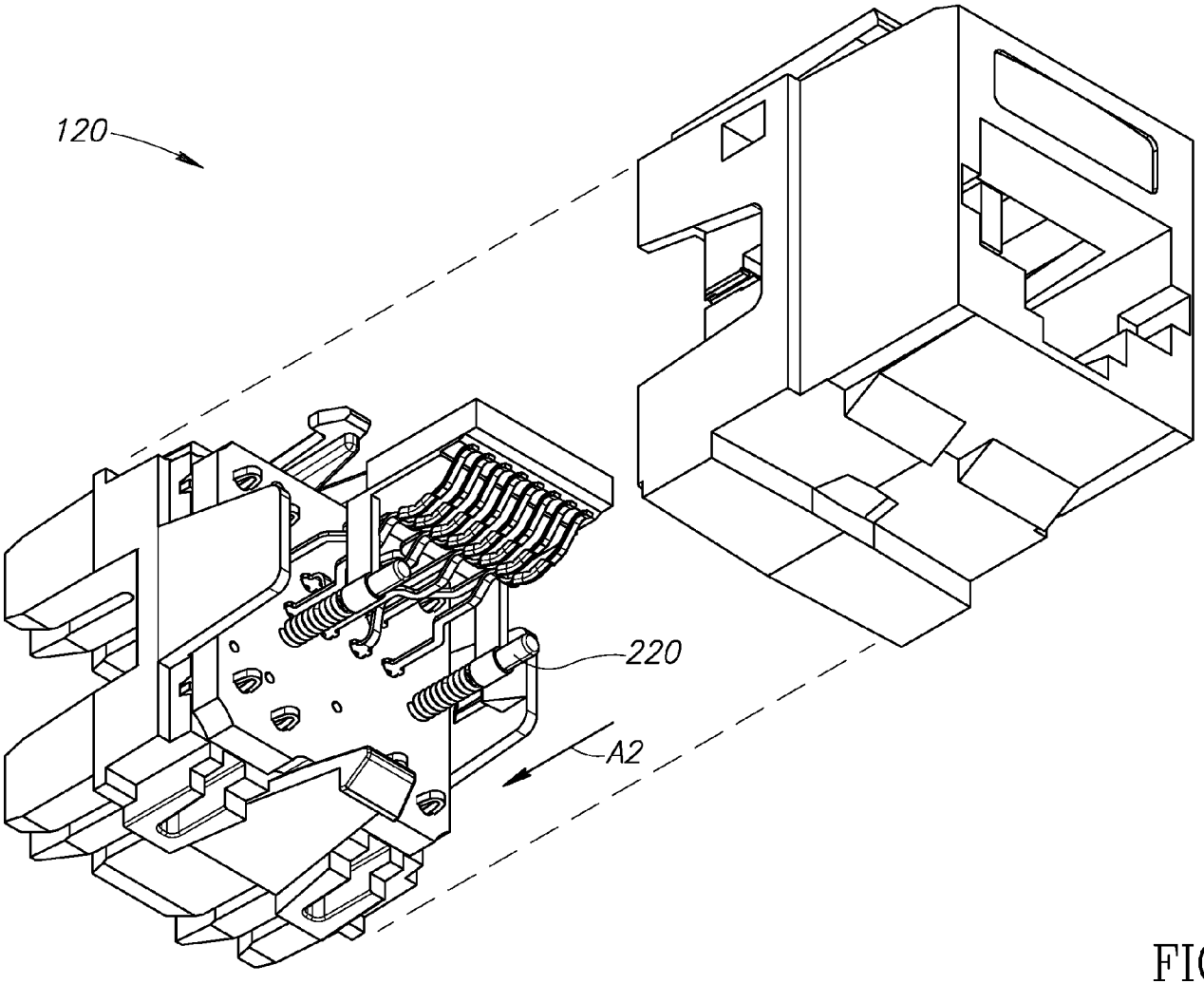
FIG. 4A is a partially exploded perspective view of the outlet of FIG. 1A operating in a first mode.
Figure 4B:
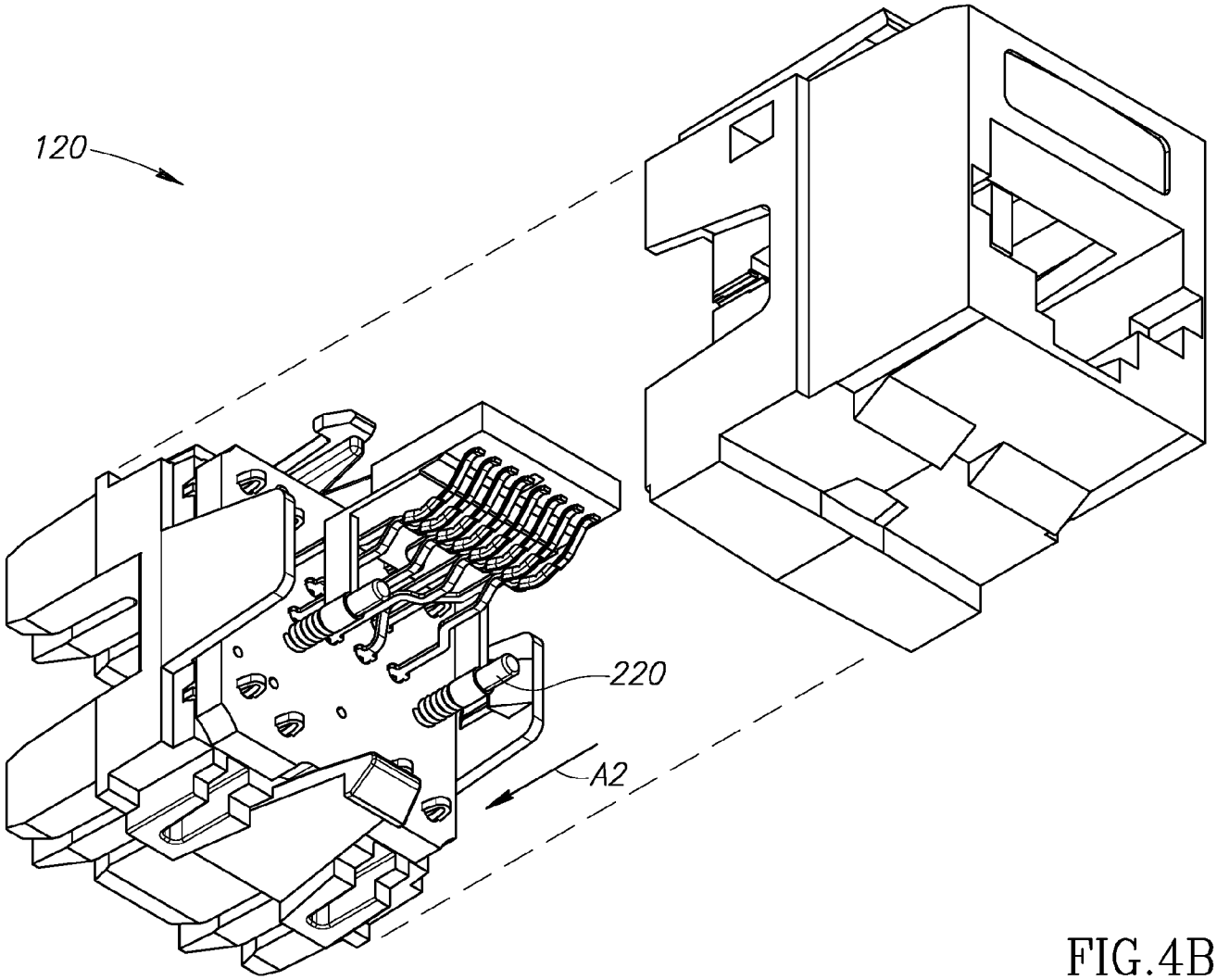
FIG. 4B is a partially exploded perspective view of the outlet of FIG. 1A operating in a second mode.

Similarly, turning to FIGS. 4A and 4B, the outlet 120 includes a mechanical switch 220 that switches the mode of operation of the outlet between the first and second electrical performance modes of operation. The outlet 120 is configured to operate in the first Next Gen mode in FIG. 4A. The outlet 120 is configured to operate in the second legacy mode in FIG. 4B. The switch 220 is configured to be automatically transitioned from the first mode (see FIG. 4A) to the second mode (see FIG. 4B) when the outlet 120 is mated with a plug (e.g., the conventional plug 160 illustrated in FIG. 1C) other than the plug 100. The switch 220 is further configured to remain in the first mode when the outlet 120 is mated with the plug 100. As explained in detail below, the switch 220 may be transitioned between the first and second modes by features present (or absent) in plugs other than the plug 100, features present (or absent) in the plug 100, and/or features present (or absent) in the outlet 120.

Because the plug 100 is backward compatible, a connection may be formed by mating the plug 100 with the outlet 120 (e.g., the connection 10 illustrated in FIG. 1A) or a conventional outlet (e.g., the conventional outlet 140 illustrated in FIG. 1B, and the like). Similarly, because the outlet 120 is backward compatible, a connection may be formed by mating the outlet 120 with the plug 100 (e.g., the connection 10 illustrated in FIG. 1A) or a conventional plug (e.g., the conventional plug 160 illustrated in FIG. 1C, and the like). Thus, FIGS. 1A-1C illustrate exemplary connections that may be formed using the plug 100 and/or the outlet 120.

While the plug 100 and outlet 120 are each configured to switch electrical performance modes of operation as disclosed herein, it is understood that any implementation and/or method of switching is acceptable as long as the plug 100 is compatible with outlet 120 (e.g. performance to Next Gen mated performance requirements) when mated with each other, and that each perform to legacy mated requirements when mated with corresponding legacy connectors.

Plug

Referring to FIGS. 5A-5C, the plug 100 includes a cover portion 300, a body portion 320, a plurality of plug contacts 340, a substrate 360, and the switch 200.

The cover portion 300 is configured to be attached to the body portion 320 to form a housing 380 (see FIGS. 2A-3D) configured to house the plug contacts 340, substrate 360, and the switch mechanism 200. The cover portion 300 may be snap fit to the body portion 320. Optionally, the cover portion 300 may be adhered (e.g., with an adhesive) to the body portion 320.

Figure 2A:
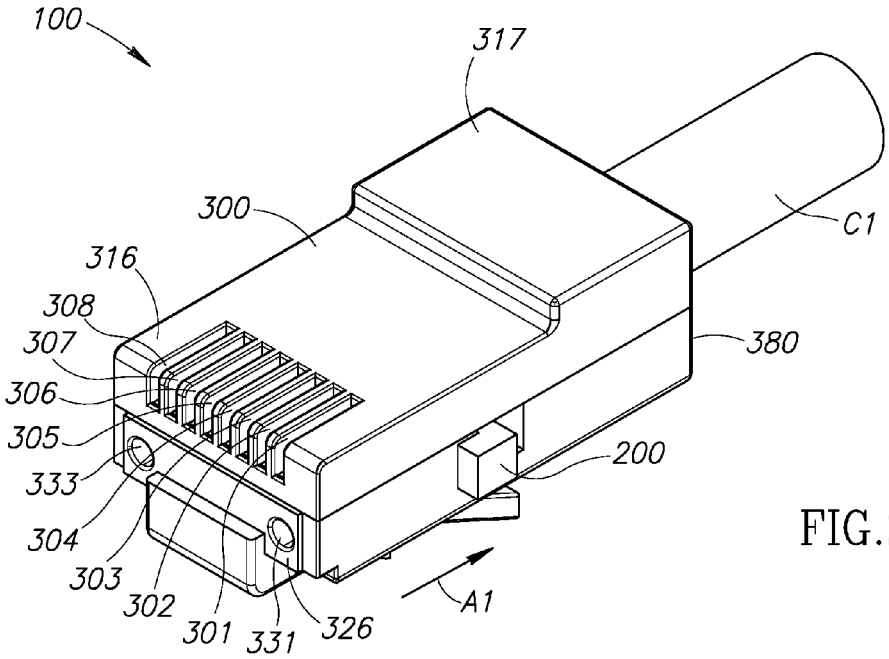
FIG. 2A is a perspective view of the plug of FIG. 1A operating in a first mode.
Figure 10A:
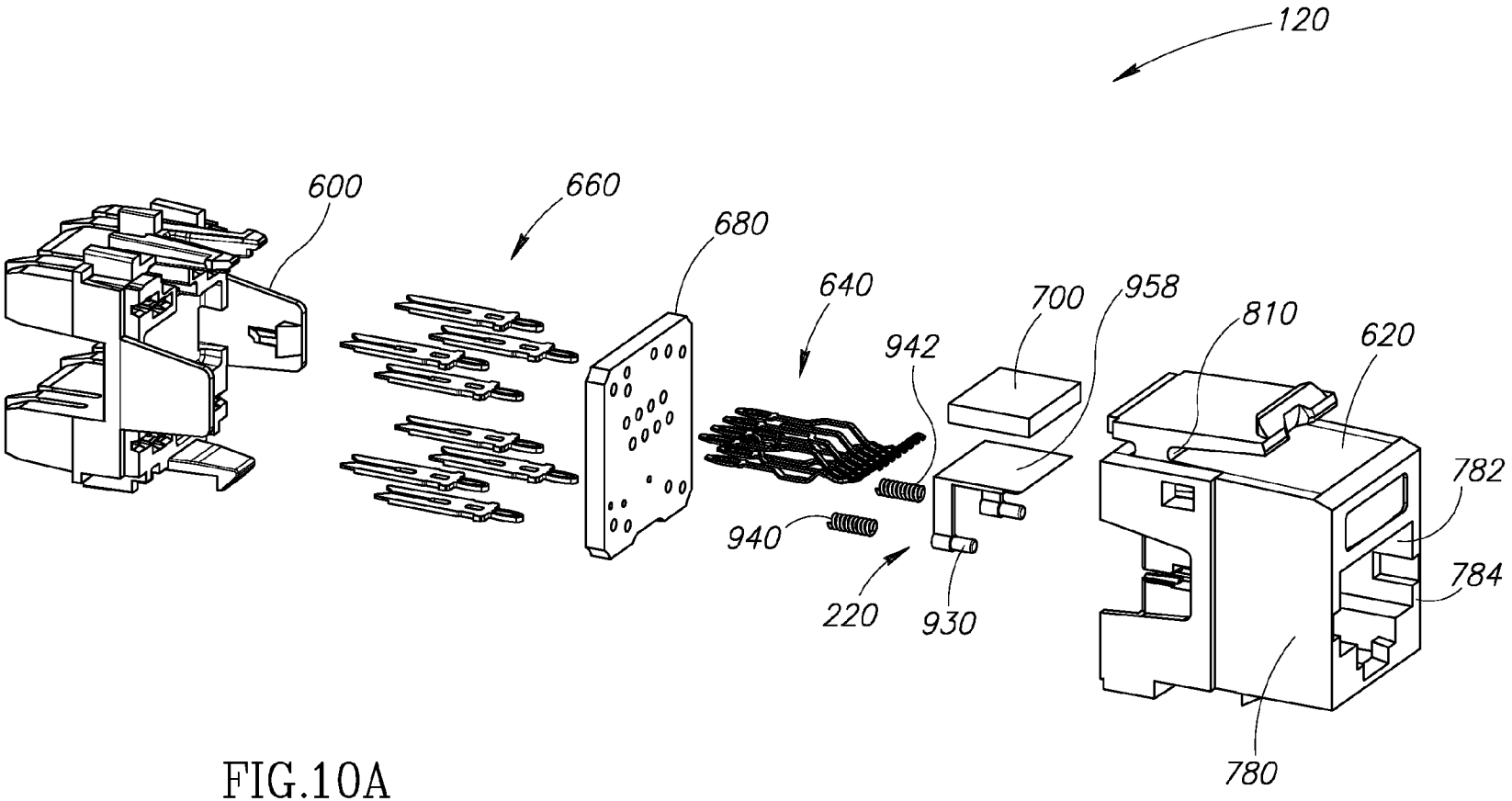
FIG. 10A is an exploded perspective view of the outlet of FIG. 1A taken from in front of the outlet.
Figure 10B:
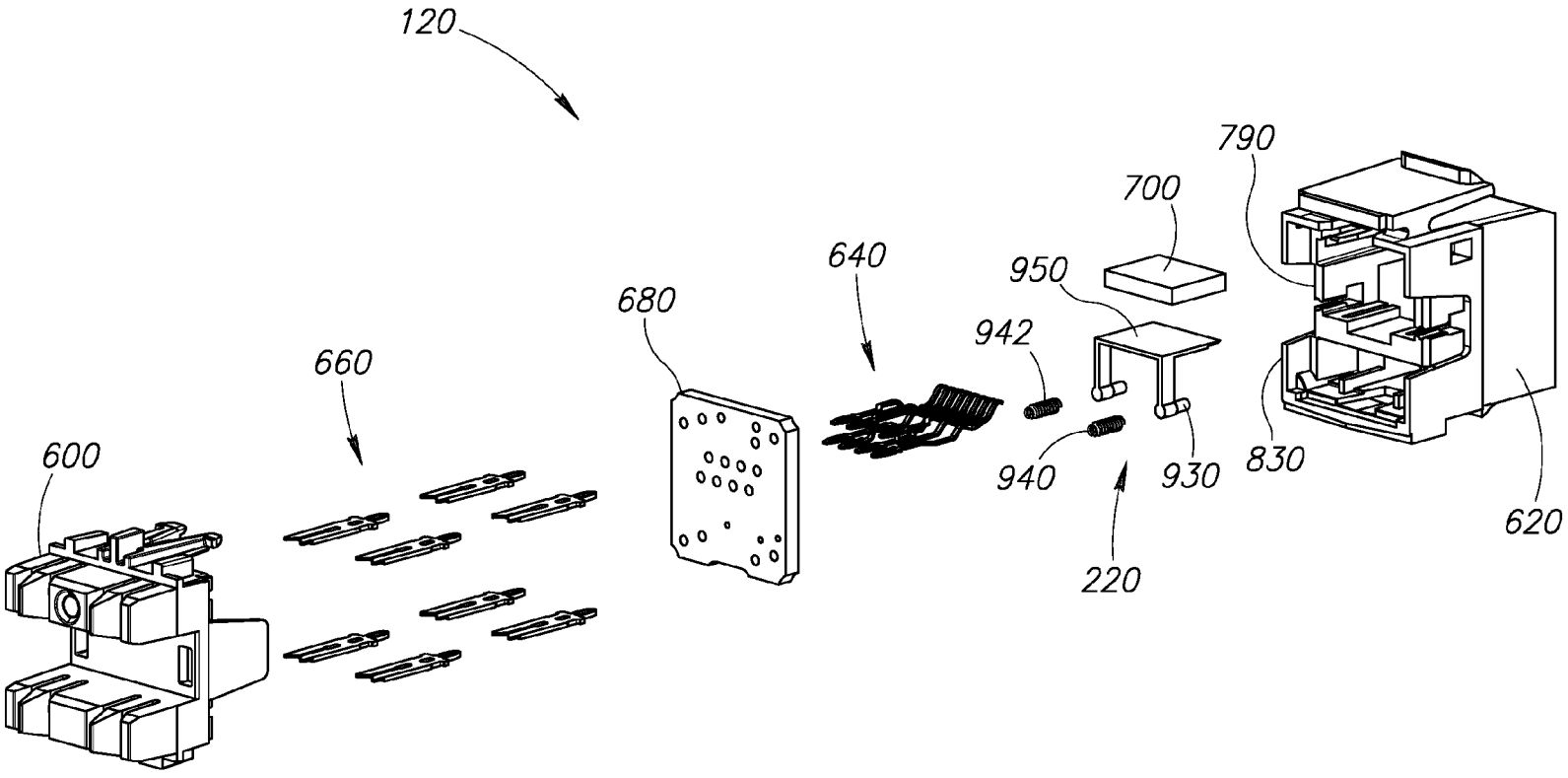
FIG. 10B is an exploded perspective view of the outlet of FIG. 1A taken from behind of the outlet.
Figure 13A:
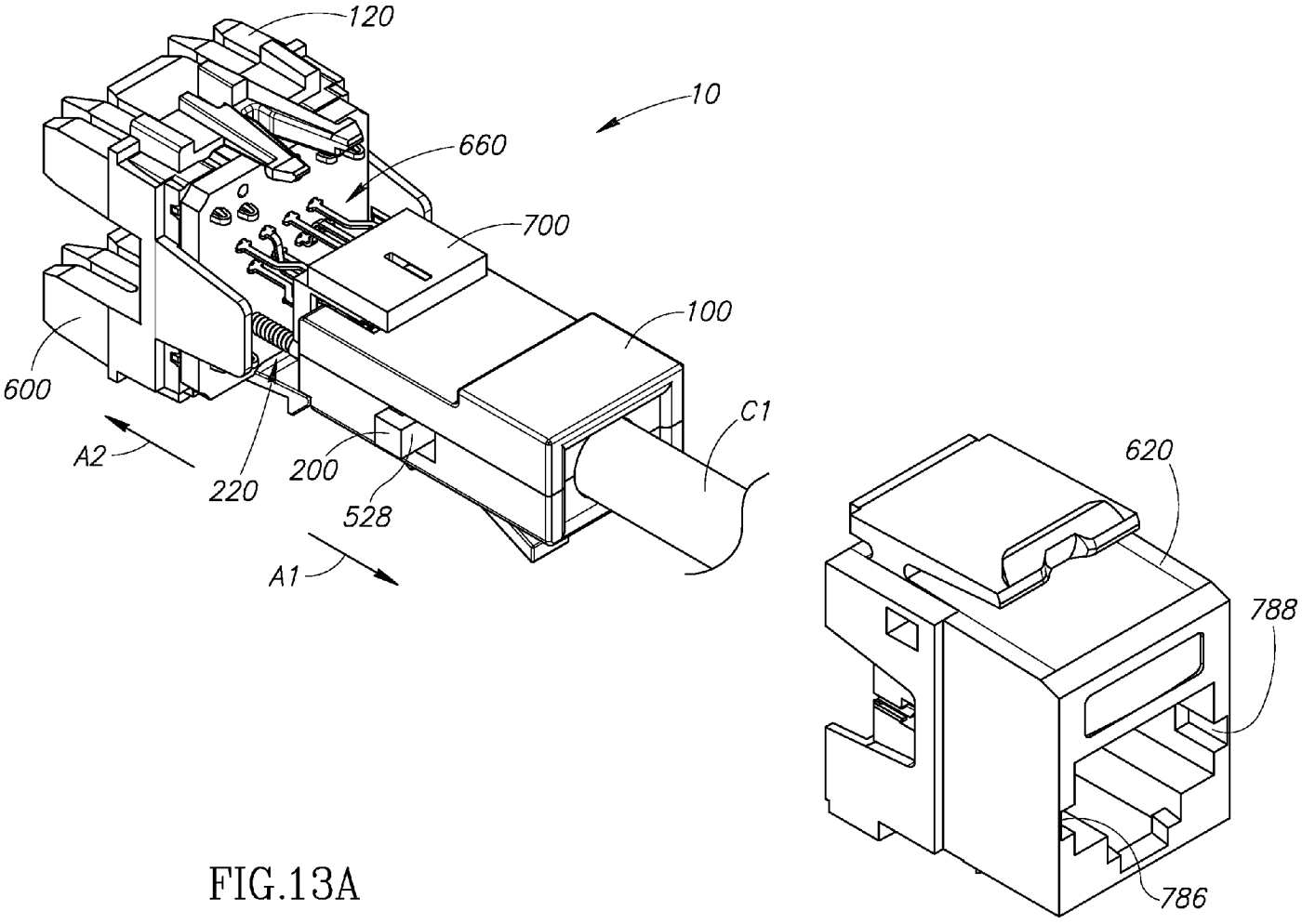
FIG. 13A is a perspective view of the connection of FIG. 1A with the body exploded from the outlet.
Figure 13B:
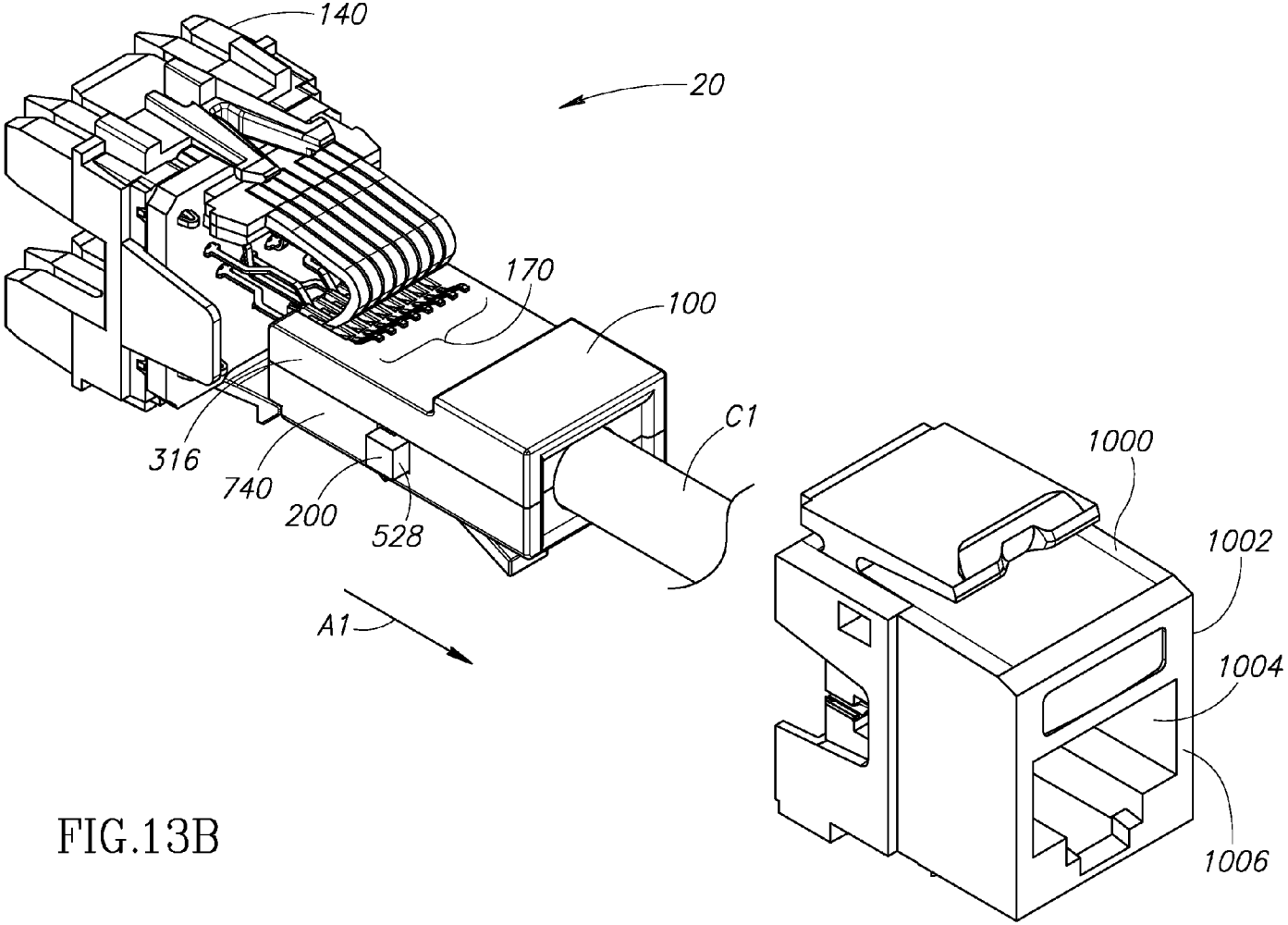
FIG. 13B is a perspective view of the connection of FIG. 1B with a body exploded from the conventional outlet.

Turning to FIG. 2A, the cover portion 300 includes openings 301-308 for receiving outlet contacts (e.g., outlet contacts 640 of the outlet 120 illustrated in FIGS. 10A and 10B or outlet contacts 170 of the conventional outlet 140 illustrated in FIG. 13B, and the like). The openings 301-308 provide access through which the outlet contacts may form electrical connections with the plug contacts 340. In the embodiment illustrated and as may be viewed in FIG. 5C, the plug contacts 340 include the eight individual plug contacts 341-348, which correspond to the eight wires W1-W8 of cable C1, respectively. The openings 301-308 provide access through which the outlet contacts may form electrical connections with the plug contacts 341-348 (see FIG. 5C), respectively. The approximate point at which the outlet contacts electrically connect with the plug contacts is designated by 341A-348A (see FIG. 5C). Through application of ordinary skill in the art to the present teachings, embodiments including different numbers of plug contacts (e.g., 4, 6, 10, 12, 16, etc.) may be constructed.

Turning to FIG. 5B, the cover portion 300 also includes a downward facing inside surface 310 flanked by a first downward extending sidewall 312 and a second downward extending sidewall 314.

Figure 3A:
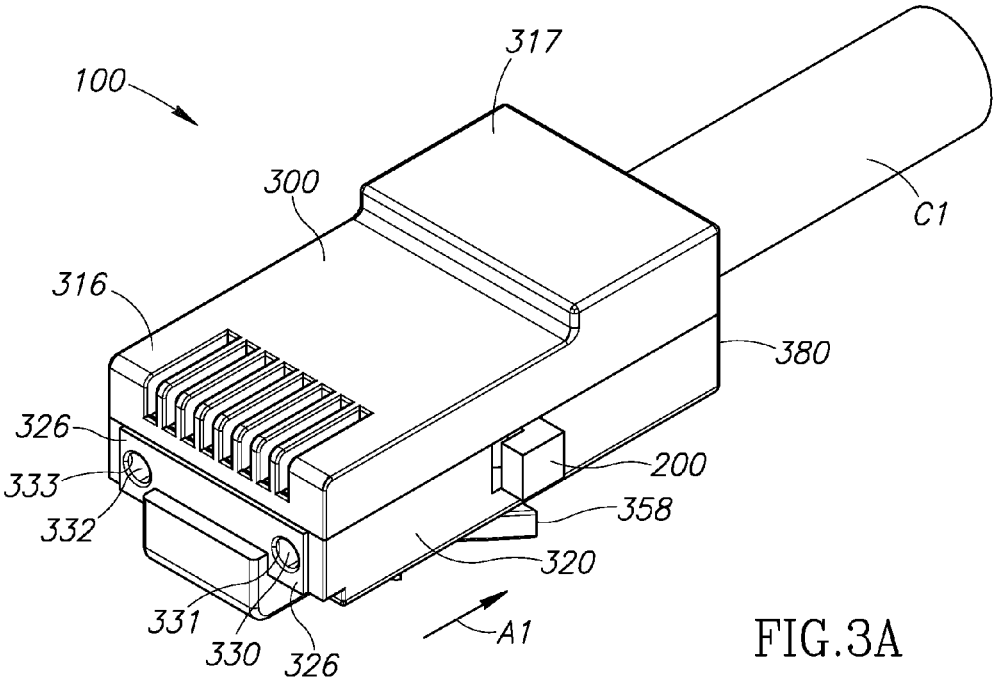
FIG. 3A is a perspective view of the plug of FIG. 1A operating in a second mode.
Figure 3B:
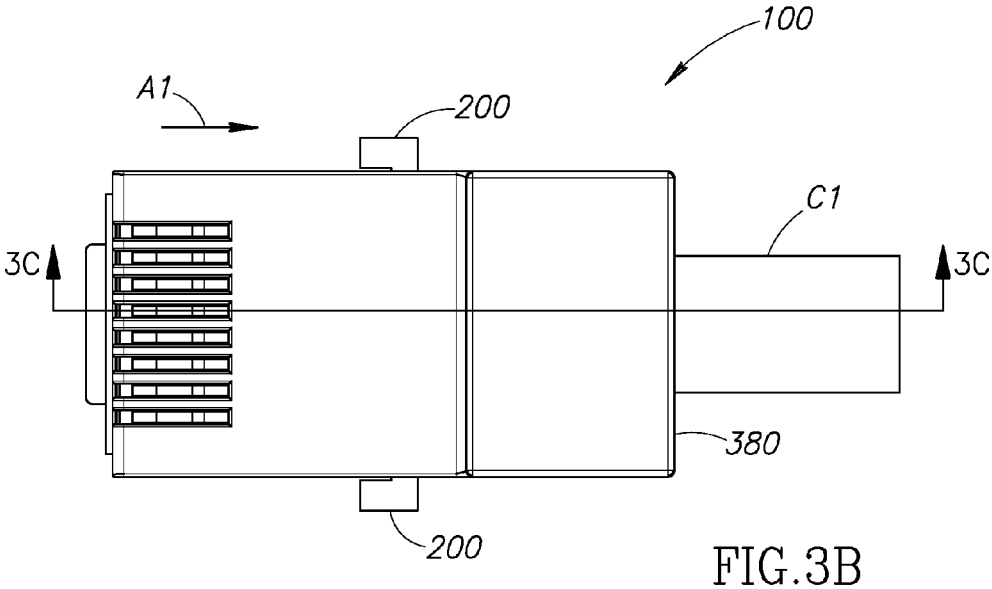
FIG. 3B is a top view of the plug of FIG. 1A operating in the second mode.

As may be viewed in FIGS. 2A and 3A, the housing 380 has a forward portion 316 opposite a rear portion 317. Turning to FIG. 5B, the cover portion 300 may include a lateral downwardly extending stop wall 315 positioned between the forward and rear portions 316 and 317 of the housing 380.

Turning to FIGS. 2A and 3A, the forward portion 316 is configured to be received by an outlet (e.g., the outlet 120 illustrated in FIG. 1A, the conventional outlet 140 illustrated in FIG. 1B, and the like). Turning to FIG. 5B, the cover portion 300 may include a lateral downwardly extending rear stop wall 318. The stop wall 318 may include a recess 319. Turning to FIG. 5A, the body portion 320 may include a lateral upwardly extending rear stop wall 322. The stop wall 322 may include a recess 323. When the cover portion 300 and the body portion 320 are assembled to form the housing 380 (see FIGS. 2A-3D), the recesses 319 and 323 are aligned. The stop walls 318 and 322 are positioned in the rear portion 317 (see FIGS. 2A and 3A) of the housing 380. The cable C1 is received inside the housing 380 through the rear portion 317 of the housing 380. In the embodiment illustrated, the cable C1 enters the housing 380 by passing through the stop walls 318 and 322 via the recesses 319 and 323.

Returning to FIG. 2A, the openings 301-308 of the cover portion 300 are positioned in the forward portion 316 of the housing 380. The forward portion 316 has a forward facing portion 326. The openings 301-308 of the cover portion 300 may extend into the forward facing portion 326 of the forward portion 316 of the housing 380.

Turning to FIG. 3A, rearwardly extending channels 330 and 332 are formed in the forward facing portion 326 of the housing 380. In the embodiment illustrated, the channels 330 and 332 are formed only in the body portion 320. However, this is not a requirement. The channels 330 and 332 have inlets or openings 331 and 333, respectively, formed in the forward facing portion 326 of the forward portion 316 of the housing 380. As will be described below, the openings 331 and 333 are configured to receive a portion of the switch 220 (see FIGS. 4A and 4B).

Figure 2B:
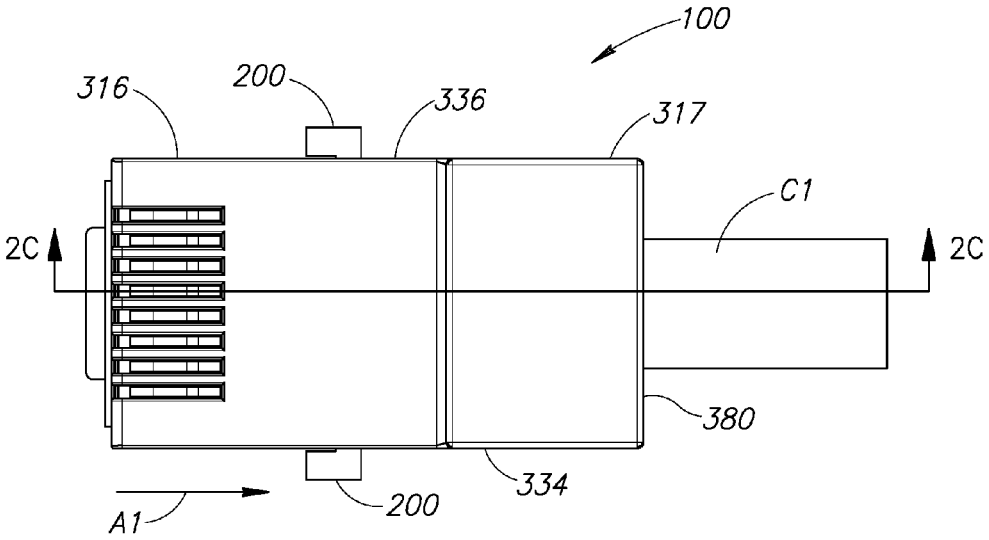
FIG. 2B is a top view of the plug of FIG. 1A operating in the first mode.

Referring to FIG. 2B, the housing 380 has a first side portion 334 opposite a second side portion 336. The substrate 360 (see FIGS. 5A and 5B) is positioned inside the housing 380 and extends laterally between the first and second portions 334 and 336 of the housing. The substrate 360 (see FIGS. 5A and 5B) also extends longitudinally between the forward portion 316 and the rear portion 317 of the housing 380.

Referring to FIG. 5A, openings 350 and 352 are formed in the first and second side portions 334 and 336, respectively, of the housing 380 (see FIGS. 2A-3D). In the embodiment illustrated, the openings 350 and 352 are formed only in the body portion 320. However, this is not a requirement. In the embodiment illustrated, the openings 350 and 352 are closed along their upper portion by the cover portion 300. Each of the openings 350 and 352 has a forward facing surface 354 confronting a rearward facing surface 355. As will be explained below, a portion of the switch 200 extends outwardly from the housing 380 through the openings 350 and 352.

The body portion 320 includes inclined ledges 356 and 357 adjacent the openings 350 and 352, respectively, wherein inclined ledges 356 and 357 slope downwardly toward openings 350 and 352, respectively.

Figure 3C:
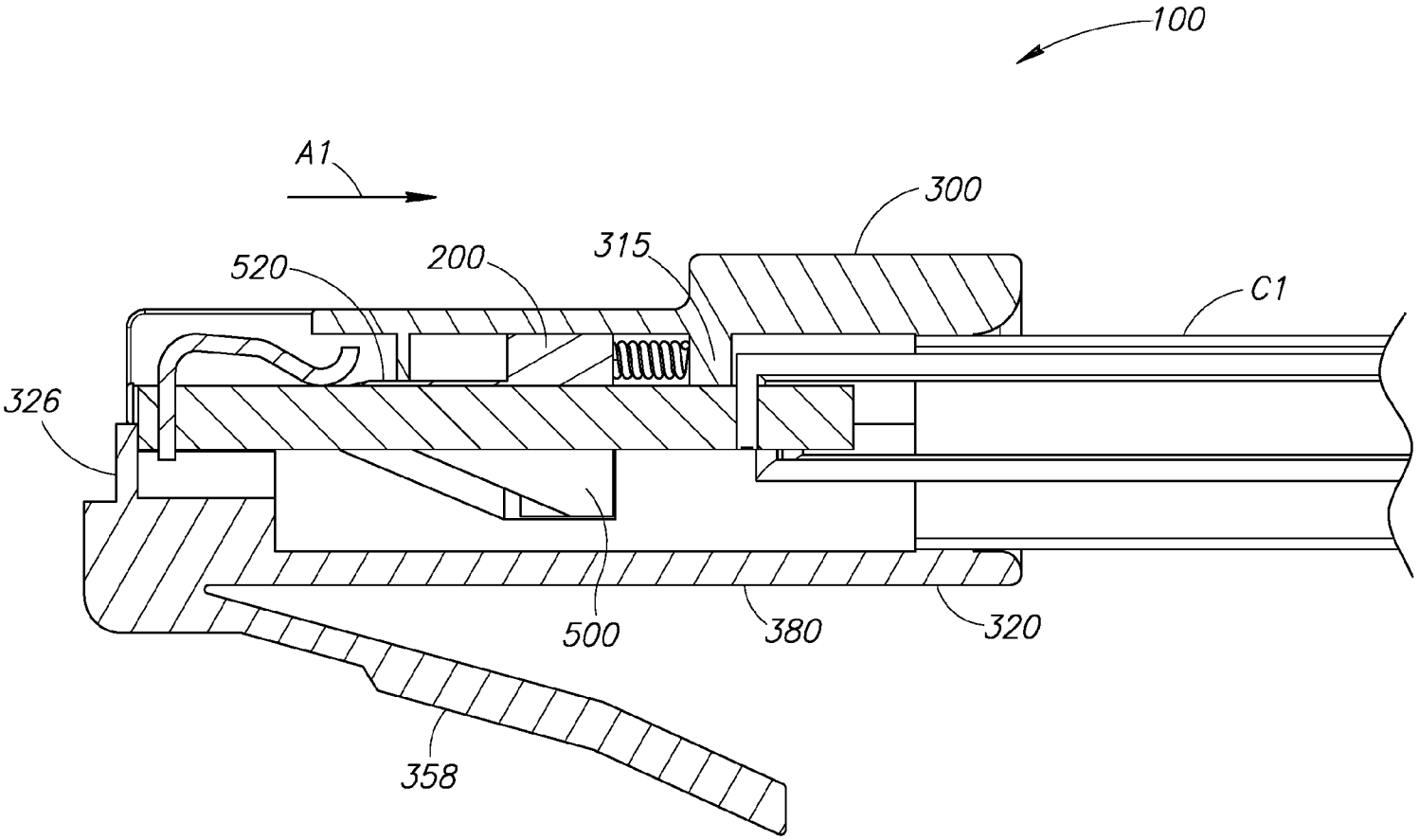
FIG. 3C is a cross sectional view of the plug of FIG. 1A operating in the second mode taken along line 3C-3C in FIG. 3B.
Figure 3D:
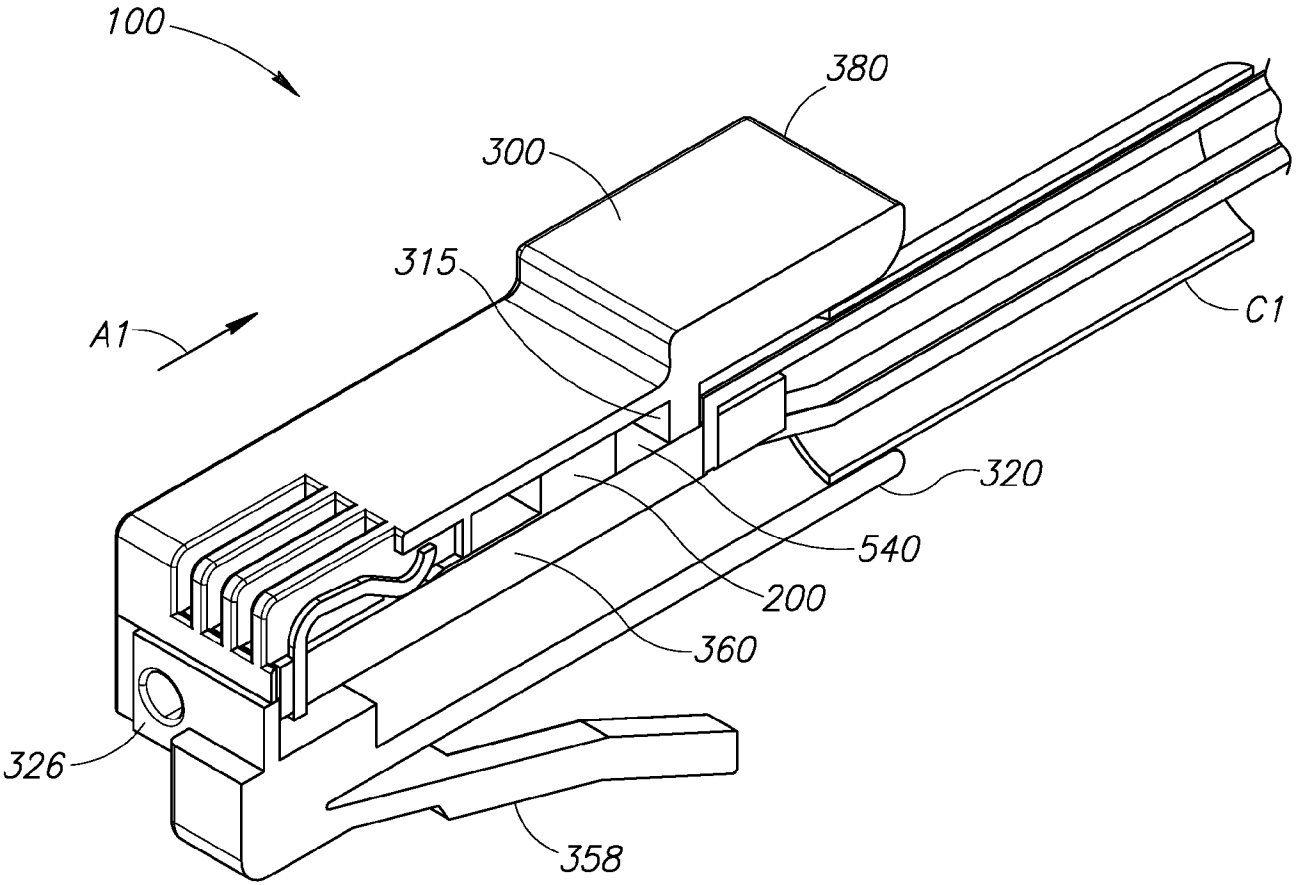
FIG. 3D is a perspective view of the cross section of FIG. 3C.

Turning to FIGS. 3C and 3D, the housing 380 includes a conventional latch member 358 configured to help maintain the plug 100 inside an outlet (e.g., the outlet 120 illustrated in FIG. 1A, the conventional outlet 140 illustrated in FIG. 1B, and the like). In the embodiment illustrated, the latch member 358 is attached to the body portion 320 and positioned to extend forward beyond the forward facing portion 326 of the housing 380. Turning to FIG. 3A, the latch member 358 is positioned between the openings 331 and 333 and does not block access thereto.

Again referring to FIGS. 2A-2C, in addition to the plug housing components shown, an electrically conductive shield (not shown) may be incorporated into the plug design. The plug shield may be integrated into the design of the plug housing 380, or added either internally or externally to the plug housing. Openings may be provided in the plug's shield to allow for the entry of cable C1 and outlet contacts 640 (See, FIG. 10A), or the outlet contacts 170 of the conventional outlet 140 (See FIG. 13B). The plug's shield may be electrically connected to the cable's (e.g. C2) shield (if present), using a low impedance electrical connection. Regardless of how the plug shield is implemented, a conductive element (not shown) connected to the plug's shield may be provided on both sides of the plug, 334 and 336 (See e.g., FIG. 5A), near the plug contacts 340, to make contact with corresponding conductive elements in the outlet which are, in turn, connected to the outlet's shield to electrically isolate conductive elements of the plug from other conductive elements external to the plug.

Turning to FIG. 5C, the substrate 360 may be implemented as a printed circuit board ("PCB"). The substrate 360 includes plated through-holes 361-368 spaced apart from plated through-holes 371-378. In the embodiment illustrated, the substrate 360 has a first side 390 opposite a second side 392. The substrate 360 may also include additional internal layers capable of being configured with various conductive elements. Inside the housing 380 (see FIGS. 2A-3D), the first side 390 of the substrate 360 is adjacent the cover portion 300 (see FIGS. 5A and 5B), and the second side 392 of the substrate 360 is adjacent the body portion 320 (see FIGS. 5A and 5B). The plated through-holes 361-368 and 371-378 each extends between the first and second sides 390 and 392 of the substrate 360. These plated through-holes may also be electrically connected to conductive elements on other internal layers of substrate 360 if present. Electrically conductive pads or contacts P1-P8 are formed on the first side 390 of the substrate 360.

Figure 5D:
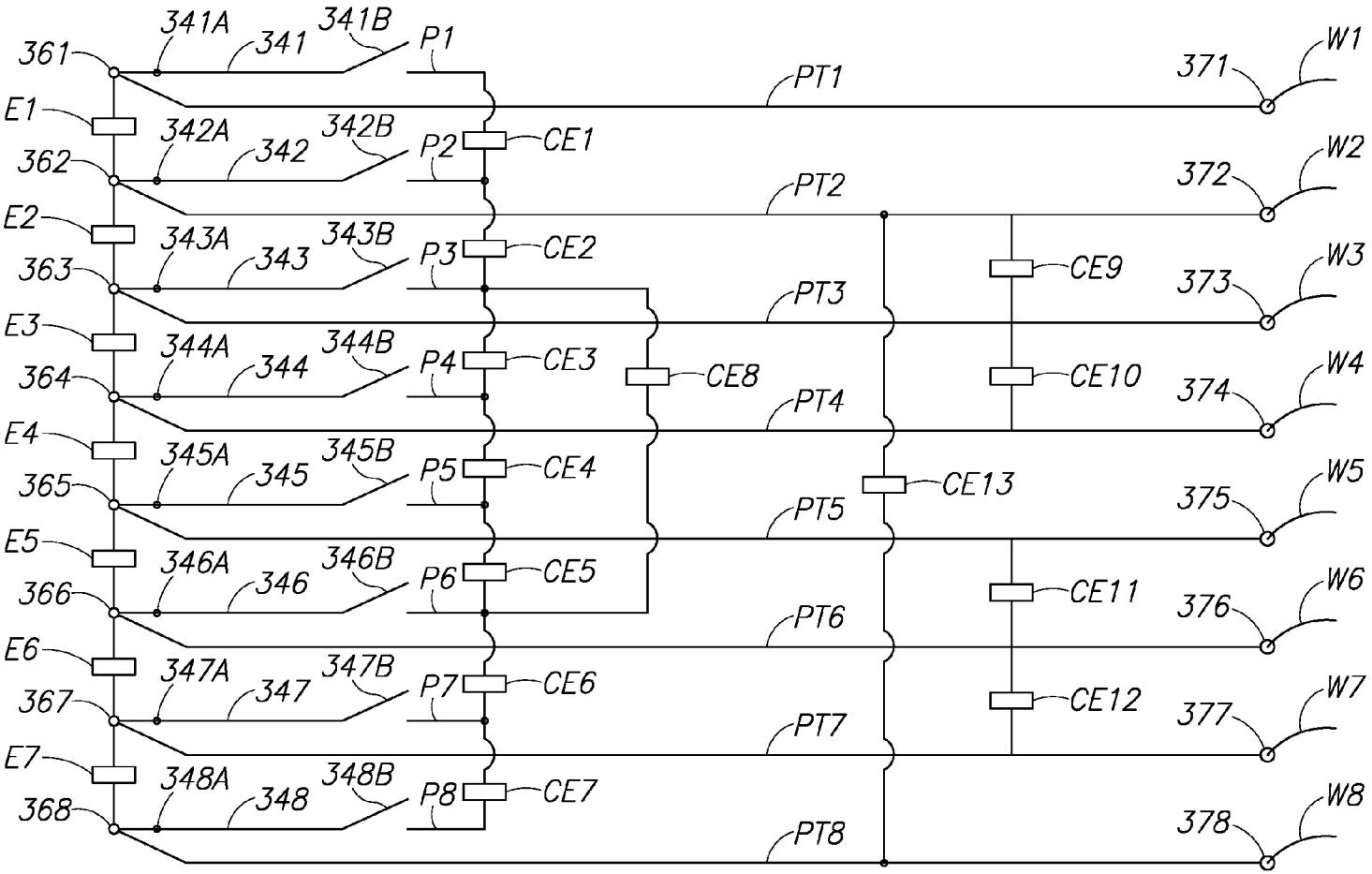
FIG. 5D is a representative electrical circuit diagram of the electrical components of the plug of FIG. 1A.

FIG. 5D illustrates a representative electrical circuit diagram of the plug 100. Circuit paths PT1-PT8 electrically connect the plated through-holes 361-368 with the plated through-holes 371-378, respectively. As can be seen in FIGS. 5C-5D, the individual plug contacts 341-348 each have one fixed end 440 mounted into substrate 360 via plated through-holes 361-368, respectively, and a second non-fixed, free end 442 formed to create switch contact points 341B-348B which are located directly above contact pads P1-P8, respectively. In FIG. 5D, the plug 100 is illustrated operating in the first (Next Gen) mode. In this first mode, the plug contacts 341-348 switch contact points 341B-348B do not contact the contact pads P1-P8. In contrast, in the second (legacy) mode, the plug contacts 341-348 switch contact points 341B-348B contact the contact pads P1-P8, respectively, and form electrical connections therewith.

Elements E1-E7 represent the electrical couplings that exist between those contacts of plug contacts 341-348 that are physically adjacent to one another, e.g. plug contacts 341 and 342, plug contacts 342 and 343, and so forth. These electrical couplings may be a combination of coupling between the plug contacts 341-348 themselves, their associated plated through holes, 361-368, and additional associated conductive structures. These couplings may contain a combination of various forms of electrical coupling e.g. capacitive, inductive and/or conductive.

Coupling elements CE1-CE7 may be implemented on the substrate 360. These coupling elements may contain various forms of electrical coupling e.g. capacitive, inductive and/or conductive. These coupling elements may not be equal depending on the location and function within the overall plug circuit. Coupling elements CE1-CE7 may be connected between select pairs of the contact pads P1-P8 to provide additional coupling between select plug contacts 341-348 when the switch contacts 341B-348B, formed in the non-fixed ends 442 of the plug contacts, are allowed to come in contact with their associated contact pads P1-P8. As mentioned above, in the first (Next Gen) mode, the switch contacts 341B-348B formed at the non-fixed ends 442 of the individual plug contacts 341-348 do not contact the contact pads P1-P8. Thus, the coupling elements CE1-CE7 are not connected to the plug circuit in any manner when the plug is used in the first (Next Gen) mode. On the other hand, in the second (legacy) mode, the switch contacts 341B-348B formed at the non-fixed ends 442 of individual plug contacts 341-348 are in contact with the contact pads P1-P8. In the second mode, the coupling elements CE1-CE7 may provide additional coupling between those contacts of individual plug contacts 341-348 that are physically adjacent to one another (e.g. plug contacts 341 and 342, plug contacts 342 and 343, and so forth), respectively. That is to say, element CE1 may provide additional coupling between plug contacts 341 and 342, element CE2 may provide additional coupling between plug contacts 342 and 343, element CE3 may provide additional coupling between plug contacts 343 and 344, and so forth. The coupling provided by elements CE1-CE7 may cause the plug to electrically resemble a conventional RJ-45 plug which typically consists of spade contacts and associated wiring (e.g., the legacy plug 160 illustrated in FIG. 1C).

As stated earlier, elements CE1-CE7 may not all effect equal coupling. These coupling elements, which may be located between contact pads which are associated with the same pair, e.g. elements CE1, CE4 and CE7, may be specified independently in such a manner as to improve the RL performance of the specific pair to which they are associated. In addition to elements CE1, CE4 and CE7, there may be an additional coupling element, CE8, which may also be located on substrate 360, which may connect between P3 and P6. Element CE8, too, may be specified independently in such a manner as to improve the RL performance of the specific pair to which it may be associated. As with coupling elements CE1-CE7, it is understood by those of ordinary skill in the art that optional element CE8 may include capacitive, inductive and/or conductive coupling elements.

Other coupling elements may be mounted on the substrate 360. For example, coupling elements CE9-CE12 may be positioned on the substrate 360 generally near plated through-holes 371-378. Coupling elements CE9-CE12 may form connections between select traces PT1-PT8 and any conductive elements associated therewith. In the embodiment illustrated, coupling element CE9 may provide additional coupling between traces PT2 and PT3, coupling element CE10 may provide additional coupling between traces PT3 and PT4, coupling element CE11 may provide additional coupling between traces PT5 and PT6, and coupling element CE12 may provide additional coupling between traces PT6 and PT7. As with coupling elements CE1-CE9, it is understood by those of ordinary skill in the art that coupling elements CE9-CE12 may include capacitive, inductive and/or conductive coupling elements. The purpose of coupling elements CE9-CE12, if present, would be to assist in adjusting the overall performance of the plug over a range of frequencies such that its electrical performance is improved in both the first (Next Gen) and second (legacy) electrical performance modes of operation.

Additional couplings may be added elsewhere in the plug on substrate 360 to provide coupling between any combination of PT1-PT8 and their associated conductive elements, at any point, to assist in improving the electrical performance over frequency in both the first (Next Gen) and second (legacy) electrical performance modes of operation. One non-limiting example of this is optional coupling element CE13 which is shown in FIG. 5D. CE13 may provide additional coupling between PT2 and PT8 at a location which is different than where CE9-CE12 may be generally located. As with coupling elements CE1-CE12 it is understood that coupling element CE13 may include capacitive, inductive and/or conductive coupling elements.

It should be noted that, unlike coupling elements CE1-CE8 which may be switched in and out of the plug's electrical circuit depending on the mode of operation of the plug (e.g. first (Next Gen) or second (legacy)) mode, coupling elements CE9-CE13 may be present in the electrical circuit of the plug at all times and thus formed in such a manner as to work effectively in both modes of plug operation.

And, as understood by one of ordinary skill in the art, the coupling and compensation elements described herein are not limiting and may be accomplished in other ways.

Turning to FIG. 5C, a portion (not shown) of the outer layer of insulation 184 is removed from the end of each of the wires W1-W8 and exposed portions (not shown) of the electrical conductors 182 of the wires W1-W8 are received inside the plated through-holes 371-378, respectively, to form electrical connections therewith. In the embodiment illustrated, the wires W1, W2, W3, and W6 are received inside the plated through-holes 371, 372, 373, and 376, respectively, from the first side 390 of the substrate 360, and the wires W4, W5, W7, and W8 are received inside the plated through-holes 374, 375, 377, and 378, respectively, from the second side 392 of the substrate 360. Thus, each of the wires W1-W8 is physically connected to the substrate 360 of the plug 100. Referring to FIG. 5D, the plated through-holes 361-368, traces PT1-PT8, and plated through-holes 371-378 connect the plug contacts 341-348 to the wires W1-W8, respectively.

Figure 6:
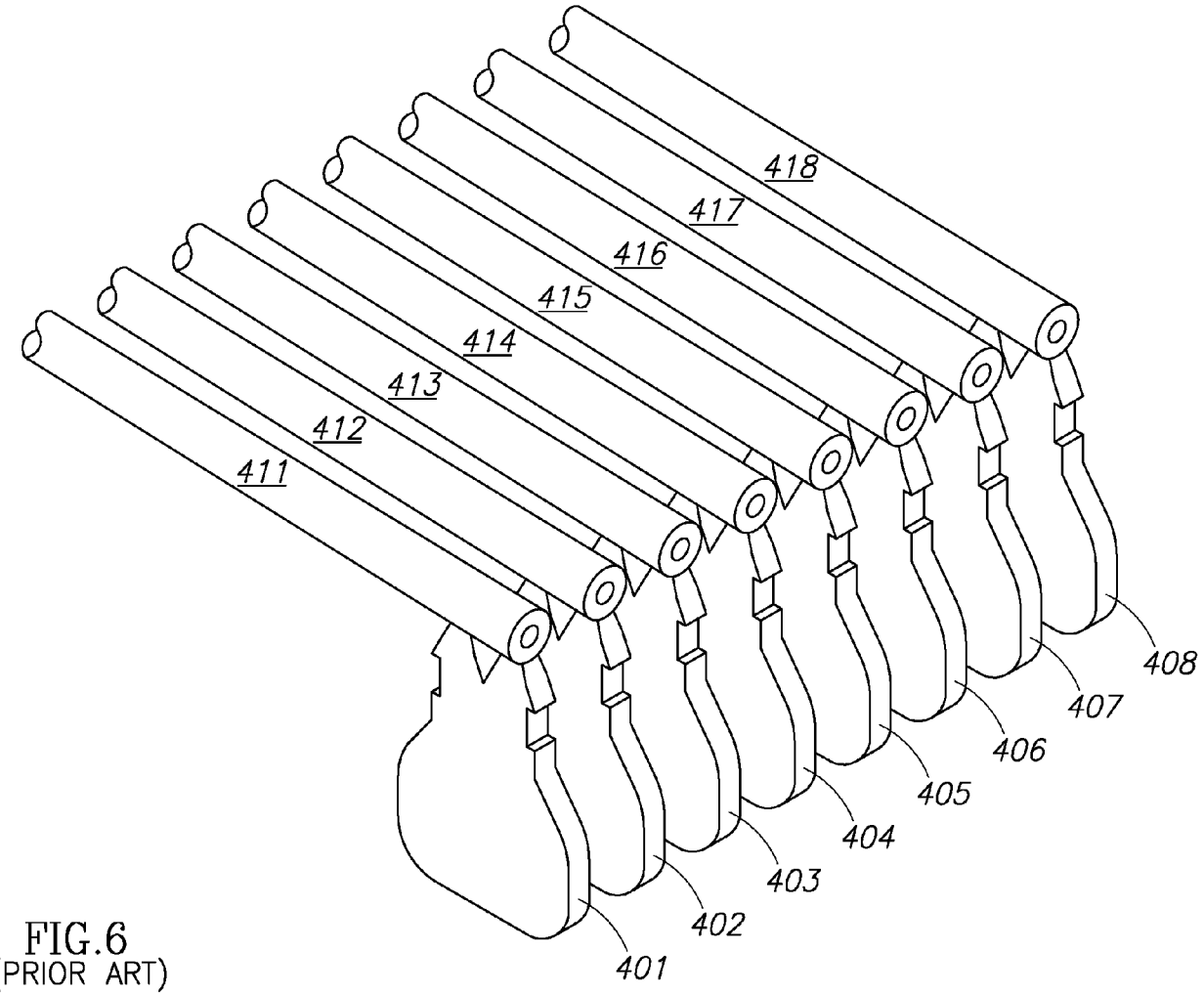
FIG. 6 (PRIOR ART)
FIG. 6 is a perspective view of a plurality of spade-shaped contacts of a prior art conventional plug.

Referring to FIG. 1C, the conventional plug 160 terminates the cable "C4" that includes wires 411-418 depicted in FIG. 6. Referring to FIG. 6, the conventional plug 160 (see FIG. 1C) includes fairly large spade-shaped contacts 401-408 electrically connected to the wires 411-418, respectively, of the cable C4. The spade-shaped contacts 401-408 form a physical and electrical connection with both the outlet contacts (e.g., the outlet contacts 641-648 illustrated in FIG. 10C) in an outlet (e.g., the outlet 120 of FIG. 1A) in which the plug is inserted and the wires 411-418 in the cable "C4" to which the conventional plug 160 is attached. Noise may be reduced inside the conventional plug 160 by reducing undesired coupling between the spade-shaped contacts 401-408. This undesired coupling may be reduced by reducing the size and/or surface area of the spade-shaped contacts 401-408.

The size and/or surface area of the spade-shaped contacts 401-408 may be reduced by replacing them with spade-shaped frame structures (e.g., the plug contacts 341-348 illustrated in FIG. 5C) that each has approximately the same outer shape as one of the conventional spade-shaped contacts 401-408. Further, referring to FIG. 5C, the plug contacts 340 may be strategically arranged on the substrate 360 in a manner that reduces coupling between adjacent ones of the plug contacts 340.

Each of the plug contacts 340 is constructed from an electrically conductive material. As noted, each of the plug contacts 340 has a forward most or fixed end portion 440 spaced apart from an aft most or free end portion 442.

The fixed end portions 440 of the plug contacts 341-348 are mounted on the substrate 360 (e.g., using the plated through-holes 361-368, respectively, or similar structures). As described above, the wires W1-W8 of the cable C1 are inserted into the plated through-holes 371-378, respectively. The traces PT1-PT8 connect the plated through-holes 361-368 (with the fixed end portion 440 of the plug contacts 340 inserted therein), respectively, to the plated through-holes 371-378 (with the wires W1-W8 inserted therein), respectively, to connect the plug contacts 340 with the wires W1-W8, respectively.

The free end portions 442 of each of the plug contacts 340 are not mounted to the substrate 360. The free end portions 442 of each plug contact 340 are formed to create switch contact points 341B-348B which are located directly above contact pads P1-P8. The plug contacts 340 are configured to bias the free end portions 442 toward the contact pads P1-P8, respectively.

Returning to FIG. 5A, the switch 200 includes a movable insulator 500, and one or more biasing members 510 and 512. The insulator 500 is configured to be adjacent, and slide relative to, the first side 390 of the substrate 360.

Figure 5E:
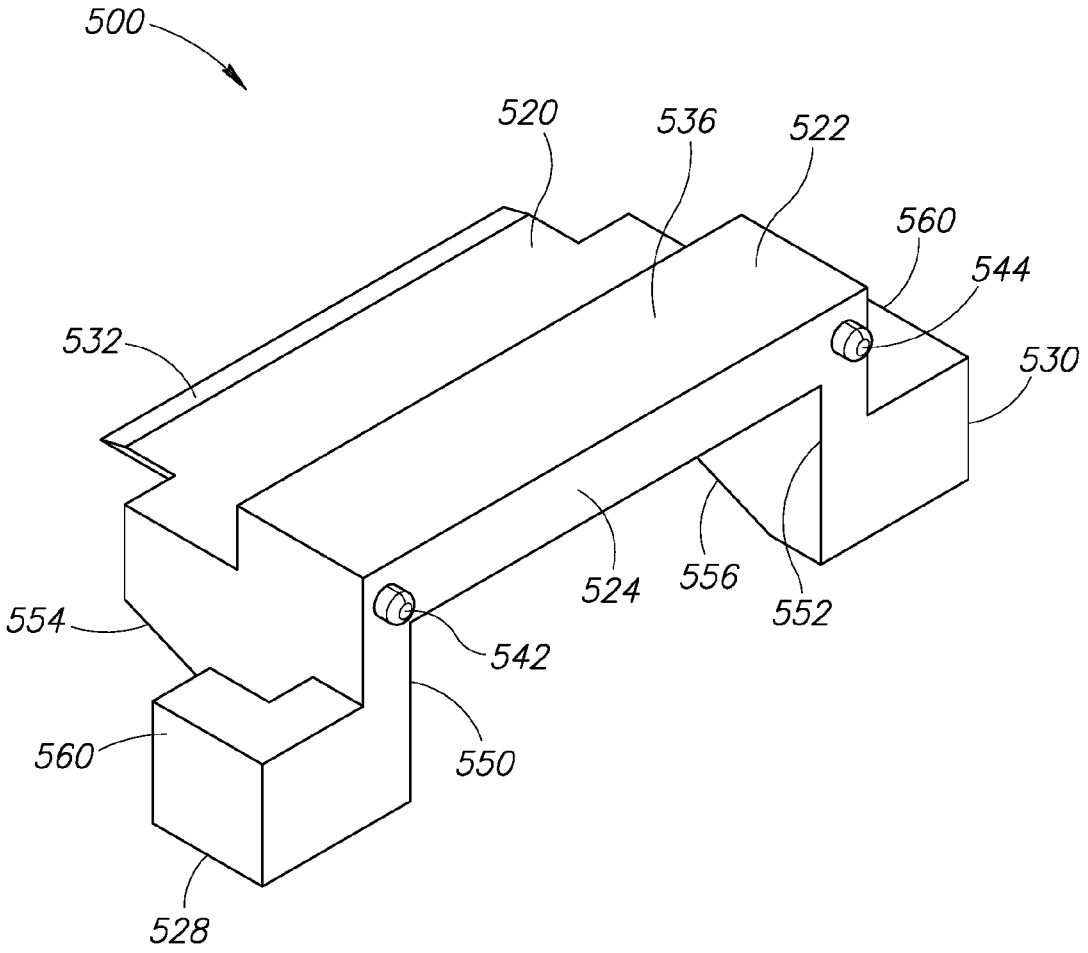
FIG. 5E is a perspective view of a rearward facing portion of a movable insulator component of a switch of the plug of FIG. 1A.

Turning to FIG. 5E, the insulator 500 has a forwardly projecting insulating portion 520, an upwardly extending or projecting portion 522, a rear portion 524 opposite the insulating portion and one or more outwardly extending projections 528 and 530. The insulator 500 is configured to slide longitudinally relative to the housing 380 (see FIGS. 2A-3D) and the substrate 360 (see FIGS. 5A and 5B) between an insulating position wherein insulator 500 is in a forward position within plug 100 such that contacts 340 rest on the surface of insulating portion 520 (see FIG. 2C) and a non-insulating position wherein insulator 500 is in a rearward position within plug 100 such that contacts 340 do not rest on the surface of insulating portion 520 (see FIG. 3C).

Figure 2C:
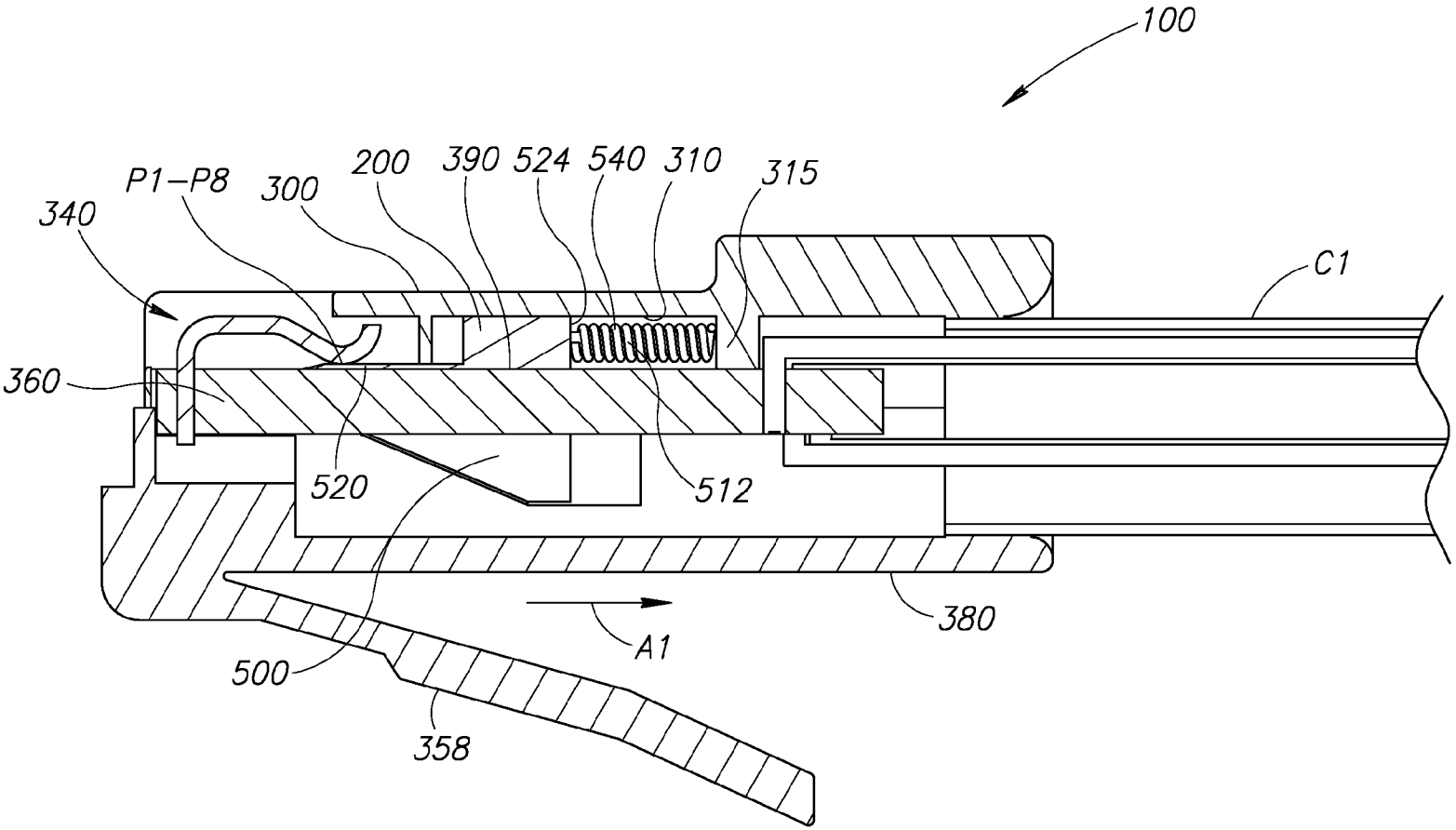
FIG. 2C is a cross sectional view of the plug operating in the first mode taken along line 2C-2C in FIG. 2B.

As may be viewed in FIG. 2C, the insulating portion 520 is configured to fit between the plug contacts 341-348 and the contact pads P1-P8. Turning to FIG. 5E, in the embodiment illustrated, the insulating portion 520 has a tapered distal edge portion 532 configured to provide an inclined plane upon which the switch contact points 341B-348B of the plug contacts 341-348 (see FIG. 5C) may slide up onto and away from the contact pads P1-P8 (see FIG. 5C) on the first side 390 of the substrate 360.

The upwardly projecting portion 522 of the insulator 500 extends upwardly beyond the insulating portion 520. The upwardly projecting portion 522 has an upper surface 536 configured to slide along the downward facing inside surface 310 (see FIG. 5B) of the cover portion 300. The upwardly projecting portion 522 may abut or be spaced apart from the downward facing inside surface 310 of the cover portion 300.

Turning to FIG. 2C, the rear portion 524 is spaced apart from the stop wall 315 of the cover portion 300. The stop wall 315 extends toward the substrate 360. A chamber 540 is defined between the first side 390 of the substrate 360, the rear portion 524 of the insulator 500, the downward facing inside surface 310 of the cover portion 300, the sidewalls 312 and 314 (see FIG. 5B) of the cover portion 300, and the forward facing portion of the stop wall 315.

Returning to FIG. 5E, optionally pegs 542 and 544 may extend rearwardly from the rear portion 524. The biasing members 510 and 512 (see FIGS. 5A and 5B) may be mounted on and at least partially positioned by the pegs 542 and 544, respectively.

Turning to FIG. 5A, the outwardly extending projections 528 and 530 are configured to extend outwardly from the housing 380 through the openings 350 and 352, respectively. Further, when the insulator 500 slides longitudinally relative to the housing 380 and the substrate 360, the projections 528 and 530 slide within the openings 350 and 352, respectively. In the embodiment illustrated, the insulator 500 is configured to slide rearward in a direction indicated by an arrow A1 (see FIGS. 2A-3D) and to slide forward in a direction opposite the direction indicated by the arrow A1. The forward facing surface 354 of the openings 350 and 352 limits the rearward movement of the projections 528 and 530, respectively. The rearward facing surface 355 of the openings 350 and 352 limits the forward movement of the projections 528 and 530, respectively.

Returning to FIG. 5E, in the embodiment illustrated, the projections 528 and 530 are mounted on downwardly extending sidewalls 550 and 552, respectively, which flank the insulating portion 520. Thus, the projections 528 and 530 may be offset vertically from the insulating portion 520. The sidewalls 550 and 552 are positioned adjacent the sidewalls 312 and 314 (see FIG. 5B), respectively, of the cover portion 300 and configured to slide with respect thereto. Turning to FIG. 5B, the sidewall 550 has a downwardly facing tapered surface 554, and the sidewall 552 has a downwardly facing tapered surface 556. The tapered surfaces 554 and 556 are configured to mate with the inclined ledges 356 and 357, respectively, when the projections 528 and 530 are in their forward most positions within the openings 350 and 352, respectively.

Optionally, each of the outwardly extending projections 528 and 530 may include a forwardly projecting portion 560 that is positioned outside the housing 380 when the projections 528 and 530 are positioned in the openings 350 and 352, respectively.

As mentioned above, the insulator 500 is selectively movable between the insulating (see FIG. 2C) and the non-insulating position (see FIGS. 3C and 3D). Turning to FIG. 5A, in the insulating position, the insulating portion 520 of the insulator 500 is positioned between the free end portions 442 (see FIG. 5C) of the plug contacts 340 and the contact pads P1-P8 (see FIG. 5C) to insulate the contact pads P1-P8 from the free end portions 442 of the plug contacts 340. In this configuration, the free end portions 442 of the plug contacts 340 rest upon the insulating portion 520 of the insulator 500 and are spaced apart from the contact pads P1-P8. When the insulator 500 is in the non-insulating position, the insulating portion 520 of the insulator 500 is not between the free end portions 442 of the plug contacts 341-348 and the contact pads P1-P8. In this configuration, the plug contacts 340 bias the free end portions 442, respectively, into contact with the contacts P1-P8, respectively. Thus, when the insulator 500 is in the non-insulating position, an electrical connection is formed between the plug contacts 341-348 and the contacts P1-P8, respectively.

The biasing members 510 and 512 bias the insulator 500 toward the insulating position. Referring to FIG. 2C, the biasing members 510 and 512 are positioned inside the chamber 540 and exert forces on the rear portion 524 of the insulator 500 and the stop wall 315 of the cover portion 300. In the embodiment illustrated, the biasing members 510 and 512 have been implemented as coil springs. Thus, when the insulator 500 is in the non-insulating position (as depicted in FIG. 3C), the biasing members 510 and 512 are compressed between the rear portion 524 of the insulator 500 and the stop wall 315 of the cover portion 300.

The one or more biasing members 510 and 512 are configured to bias the insulator 500 into the insulating position when the plug 100 is inserted into the outlet 120. When the insulator 500 is in the insulating position (see FIG. 2C), the additional coupling provided by the coupling elements CE1-CE8 (see FIG. 5D) is not utilized. This places the plug 100 in the first (Next Gen) mode.

The biasing members 510 and 512 are configured to apply a biasing force (in the (forward) direction opposite the (rearward) direction identified by the arrow A1) to the insulator 500 that positions the insulator in the insulating position. However, an external force exerted on the outwardly extending projections 528 and 530 (in the (rearward) direction identified by the arrow A1) may overcome the biasing force applied to the insulator 500 by the biasing members 510 and 512. Thus, when sufficient external force is applied to the outwardly extending projections 528 and 530, the insulator 500 is transitioned to the non-insulating position. When the insulator 500 is in the non-insulating position, the additional coupling provided by the coupling elements CE1-CE8 (see FIG. 5D) is utilized. This places the plug 100 in the second (legacy) mode.

As will be described below, the configuration of a conventional outlet (e.g., the conventional outlet 140 illustrated in FIG. 1B) exerts sufficient force on the outwardly extending projections 528 and 530 when the forward portion 316 of the housing 380 of the plug 100 is inserted into the conventional outlet to transition the insulator 500 to the non-insulating position thereby placing the plug 100 in the second (legacy) mode. On the other hand, the outlet 120 does not exert force on the outwardly extending projections 528 and 530. Thus, the insulator 500 remains in the insulating position and the plug 100 remains in the first (Next Gen) mode when the plug 100 is inserted into the outlet 120.

In an alternate embodiment (not shown), a user may manually transition the plug 100 from the first mode to the second mode. In such an embodiment, the plug 100 may include stops (not shown) positioned to maintain the plug 100 in the second mode until the user manually transitions the plug 100 back to the first mode. In such embodiments, the biasing members 510 and 512 may be omitted.

It is understood that the methods of switch operation described within are only a representative/non-limiting example of how a switching mechanism might be implemented. It is further understood that the spirit of this disclosure is to encompass all possible methods of performing the switching function.

Outlet

Referring to FIGS. 10A and 10B, the outlet 120 includes a carrier or terminal block 600, a dielectric housing or body 620, a plurality of resilient tines or outlet contacts 640, a plurality of wire contacts 660 which are designed to have wires terminated to them, a first (vertical) substrate (depicted as a printed circuit board) 680, a second (horizontal) substrate (depicted as a printed circuit board) 700, and the switch 220. In the implementation illustrated, the outlet contacts 640 include the outlet contacts 641-648 (see FIG. 10C), and the wire contacts 660 include wire contacts 661-668 (see FIG. 10E).

Referring to FIG. 1A, as mentioned above, the outlet 120 terminates the cable C2, which is substantially identical to the cable C1. For ease of illustration, the wires of the cable C2 have been identified in FIG. 12 using reference numerals JW1-JW8. The wires JW1-JW8 are substantially identical to the wires W1-W8, respectively. Further, the wires JW1-JW8 are arranged in four twisted-wire pairs that each carries a differential signal. The first twisted pair includes the wires JW4 and JW5. The second twisted pair includes the wires JW1 and JW2. The third twisted pair includes the wires JW3 and JW6. The fourth twisted pair includes the wires JW7 and JW8. The wires JW1-JW8 are housed inside an outer cable jacket 720 (see FIGS. 1A and 1C) typically constructed from an electrically insulating material. The cable also may contain an electrically conductive shield (not shown) which is typically applied over the group of four twisted pair beneath the cable jacket 720.

Figure 7A:
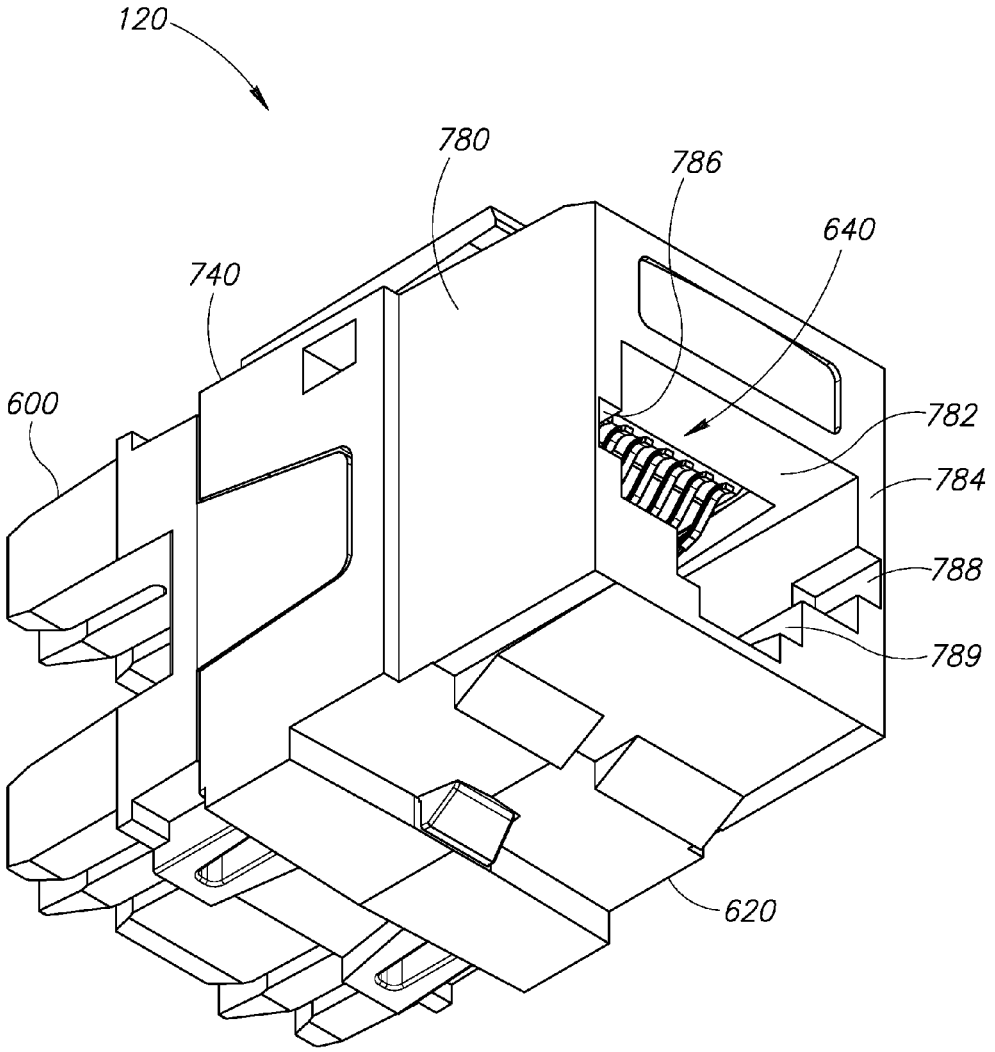
FIG. 7A is a perspective view of the outlet of FIG. 1A taken from below the outlet.
Figure 7B:
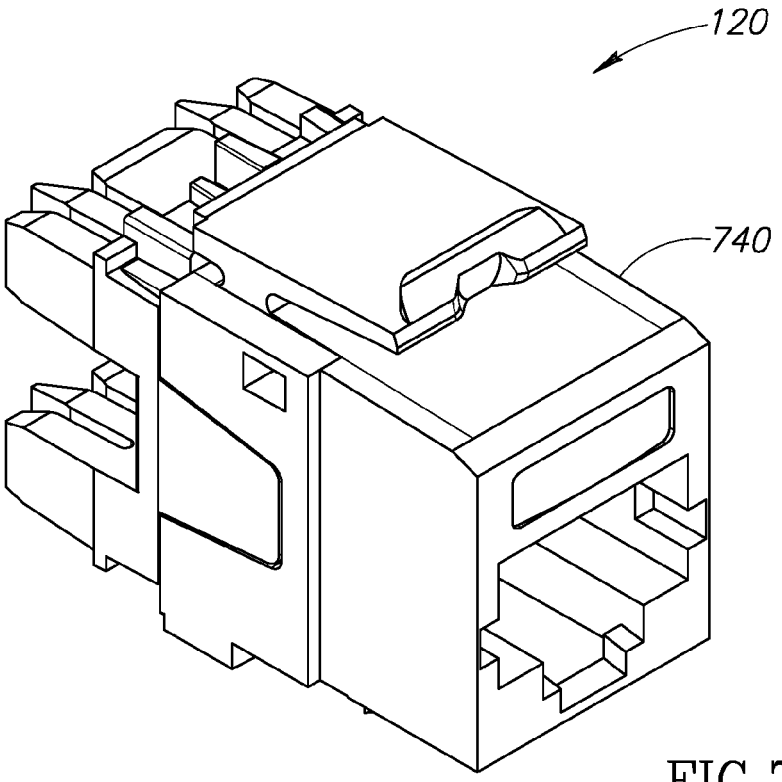
FIG. 7B is a perspective view of the outlet of FIG. 1A taken from above the outlet.
Figure 7C:
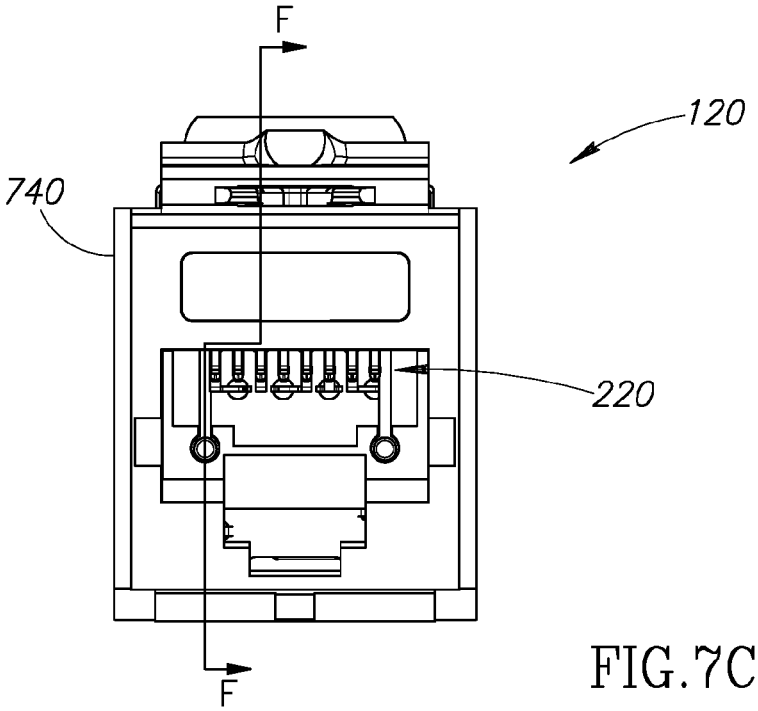
FIG. 7C is a front view into a plug receiving receptacle of the outlet of FIG. 1A.

Turning to FIGS. 7A-7C, together the terminal block 600 and the body 620 form a housing 740 that houses internal components (e.g., the outlet contacts 640, the first (vertical) substrate 680, portions of the wire contacts 660, the second (horizontal) substrate 700, and the switch 220) of the outlet 120. The terminal block 600 may be snap fit to the body 620. Optionally, the terminal block 600 may be adhered (e.g., with an adhesive) to the body 620.

Again referring to FIG. 7A, in addition to the depicted components of the outlet's housing, an electrically conductive shield (not shown) of some form may be used. The shield may be integrated into the design of the outlet body 620 itself, or added either internally or externally to the housing. The shield would also have conductive elements which generally form around the terminal block portion 600 of the outlet. Openings would be provided in the outlet's shield to permit entry of cable C2 and plug 100 (see FIG. 5A), or a conventional RJ-45 to plug into the outlet. The outlet's shield, if present, would be electrically connected to the cable's shield (if present), using a low impedance electrical connection. The plug's shield, if present, would be connected to the outlet's shield via electrically conductive elements provided in the outlet near the location of recesses 786 and 788 which make contact with corresponding electrically conductive elements on the sides of the plug and which are, in turn, connected to the plug's shield. The outlet's shield is configured to electrically isolate conductive elements of the outlet from other external conductive elements.

Figure 10C:
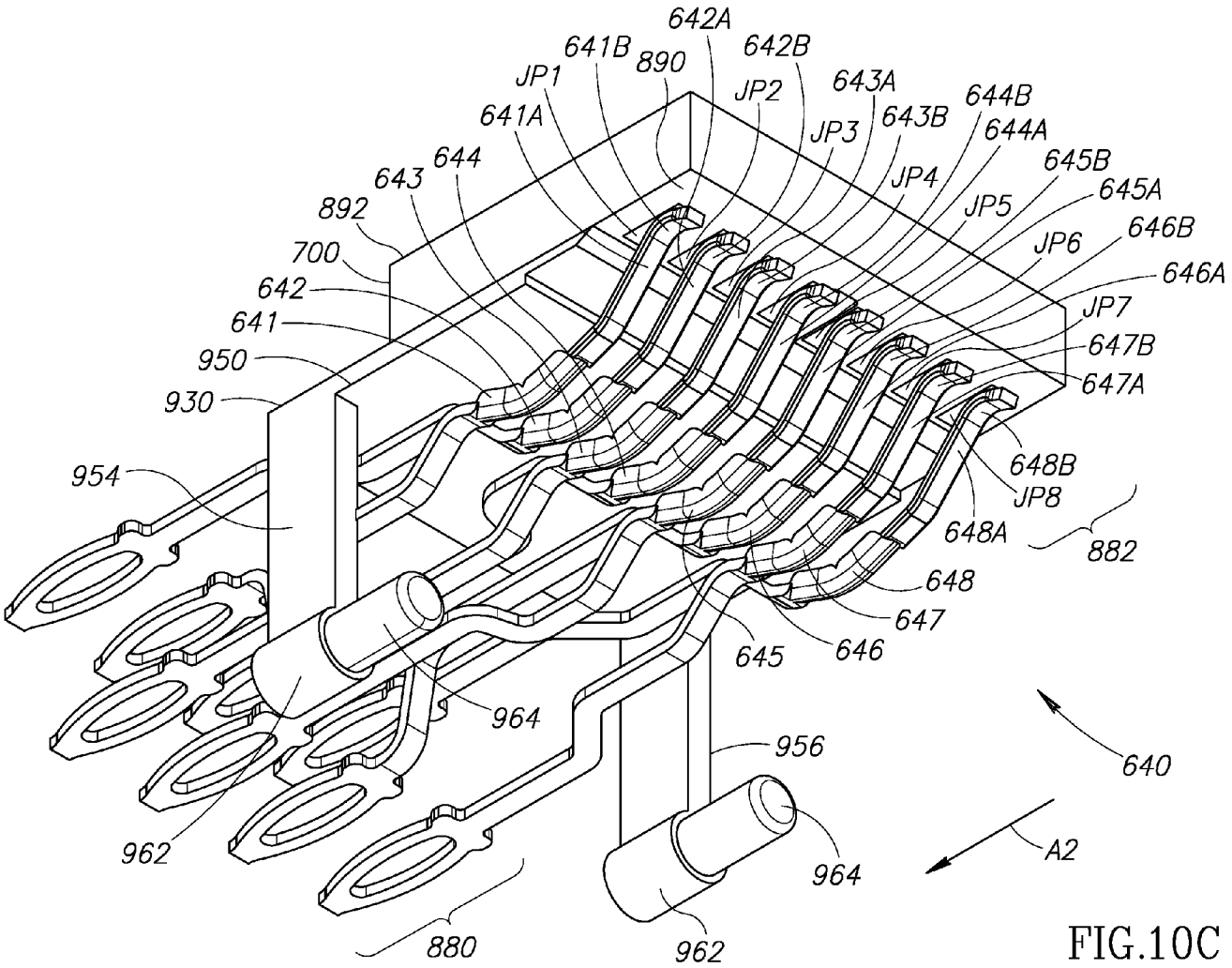
FIG. 10C is an enlargement of a portion of FIG. 4B showing a subassembly of the outlet of FIG. 1A including a plurality of outlet contacts, a second (horizontal) substrate, and a movable insulator.
Figure 10D:
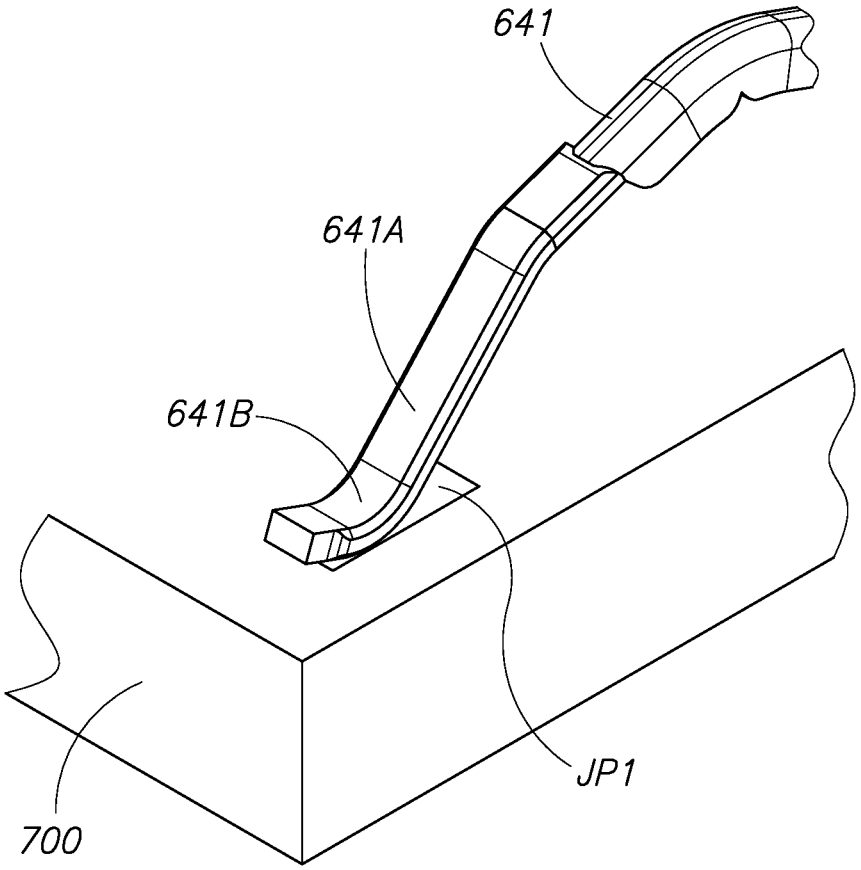
FIG. 10D is an enlargement of a portion of FIG. 10C.
Figure 10E:
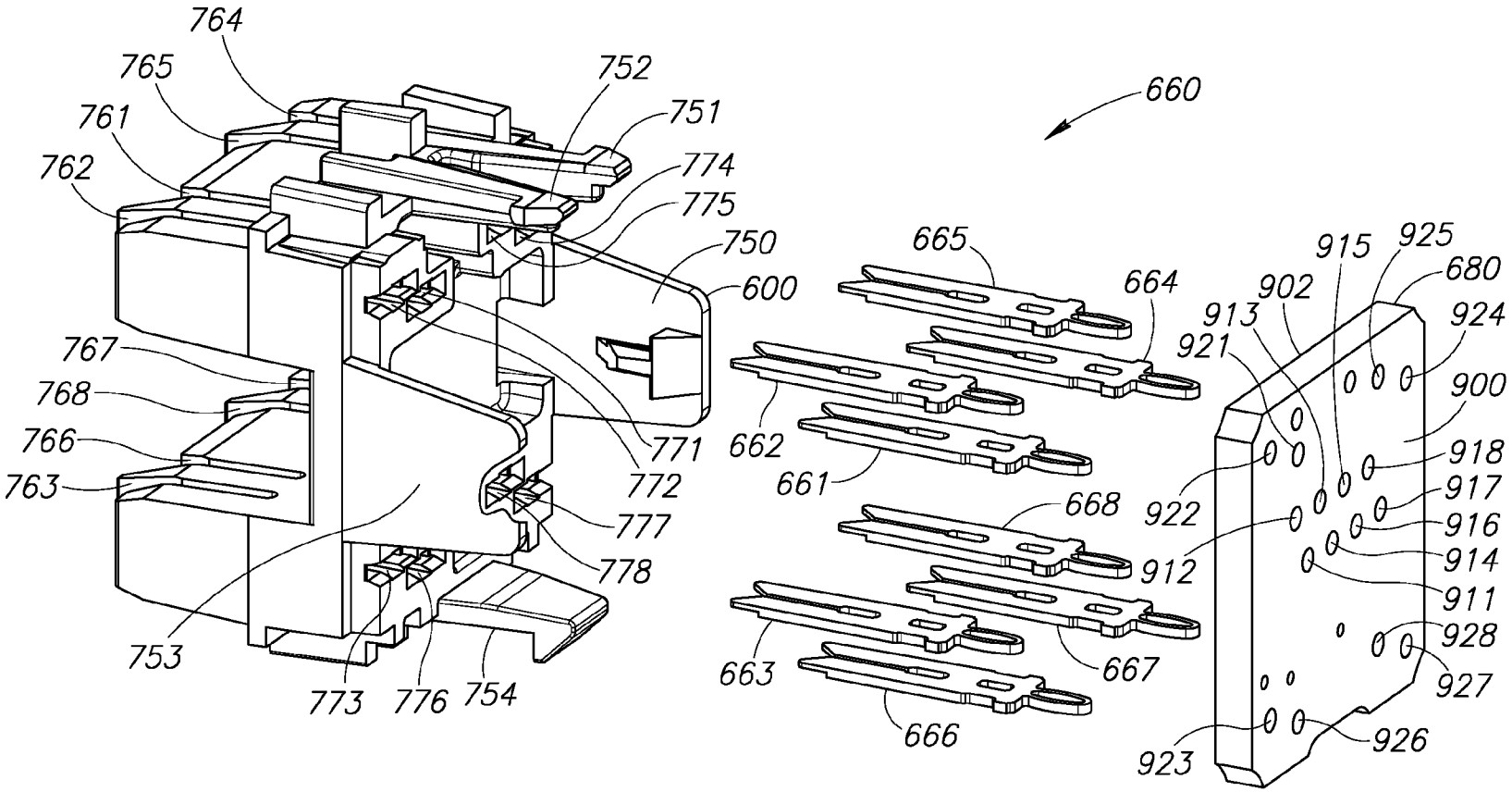
FIG. 10E is an enlargement of a portion of FIG. 10A.

Turning to FIG. 10E, the terminal block 600 may be implemented using any terminal block known in the art configured to be assembled with the body 620 (see FIGS. 10A and 10B). In the embodiment illustrated, the terminal block 600 includes forwardly extending members 750-754 configured to grip or snap on to the body 620 (see FIGS. 10A and 10B). In such embodiments, the forwardly extending members 750-754 are each configured as a male portion of a snap fit type connector.

As is apparent to those of ordinary skill in the art, at least a portion of each of the wire contacts 660 may be accessible from outside the outlet 120 so that the wires JW1-JW8 (see FIG. 12) may be connected to the wire contacts 661-668, respectively. Thus, the terminal block 600 may be configured to provide access to those portions of the wire contacts 660. In the embodiment illustrated, the terminal block 600 includes rearwardly opening slots 761-768 that provide access to portions of the wire contacts 661-668, respectively, so that the wires JW1-JW8, respectively, may be connected thereto.

Referring to FIG. 10E, in the embodiment illustrated, the terminal block 600 includes forwardly opening slots 771-778 for the wire contacts 661-668, respectively. In FIG. 10E, a portion of the forwardly extending member 753 has been removed to provide a view of the slots 777 and 778. When the outlet 120 is assembled, the wire contacts 661-668 are received inside the slots 771-778, respectively. The slots 771-778 open into the slots 761-768, respectively, through which wires JW1-JW8 (see FIG. 12), respectively, may be connected to the wire contacts 661-668, respectively.

Turning to FIG. 10A, the body 620 includes a sidewall 780 defining an interior receptacle 782. The sidewall 780 includes a frontward opening portion 784 in communication with the interior receptacle 782. As may best be viewed in FIG. 11A, which provides an enlarged view of the backside of the body 620, the sidewall 780 also includes a rearward opening portion 790 opposite the frontward opening portion 784 (see FIG. 10A) and in communication with the interior receptacle 782.

Turning to FIG. 7A, the frontward opening portion 784 of the sidewall 780 has forwardly opening recesses 786 and 788 formed therein. Each of the recesses 786 and 788 extends inwardly into the interior receptacle 782. The recesses 786 and 788 are configured to receive the projections 528 and 530 (see FIGS. 5A and 5E), respectively, (and the forwardly projecting portions 560 connected thereto) and to allow the projections 528 and 530 (and the forwardly projecting portions 560 connected thereto) to travel freely through the recesses 786 and 788 unimpeded. Thus, the body 620 avoids exerting a rearward force (e.g., in the direction opposite the direction identified by the arrow A1 illustrated in FIGS. 2A-3D) on the projections 528 and 530 when the plug 100 is inserted inside the outlet 120.

In the embodiment illustrated in FIG. 7A, the frontward opening portion 784 has a latch receiving portion 789 configured to receive and retain the latch member 358 (see FIG. 3A) of the plug 100.

Figure 11A:
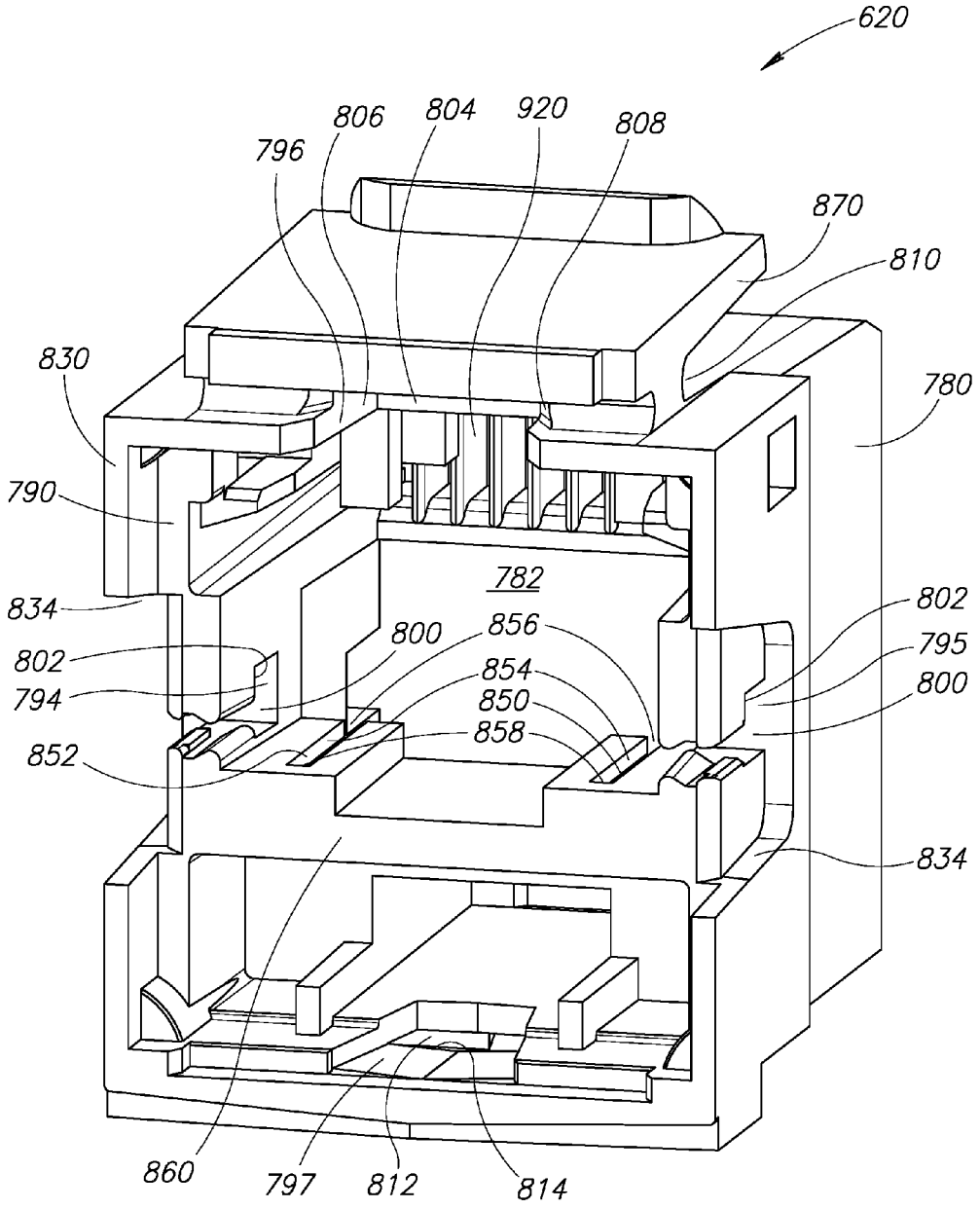
FIG. 11A is a perspective view of a rearwardly facing portion of a body of the outlet of FIG. 1A taken from above the body.

Turning to FIG. 11A, the body 620 also includes one or more connector portions 794-797 for attaching the terminal block 600 (see FIG. 10E) to the body 620. In the embodiment illustrated, the connector portions 794-797 are configured such that the body 620 and the terminal block 600 (see FIG. 10E) may be snapped together. In such embodiments, the connector portions 794-797 are each configured as a female portion of a snap fit type connector. The connector portion 794 is configured to mate with the forwardly extending member 750 (see FIG. 10E) of the body 620. The connector portion 795 is configured to mate with the forwardly extending member 753 (see FIG. 10E) of the body 620. The connector portion 796 is configured to mate with the forwardly extending members 751 and 752 (see FIG. 10E) of the body 620. The connector portion 797 is configured to mate with the forwardly extending member 754 (see FIG. 10E) of the body 620. The connector portions 794 and 795 are located on opposite sides of the sidewall 780 from one another and each include a recess or an aperture 800 at least partially defined by at least one forward facing surface 802. The connector portions 796 and 797 are located on opposite sides of the sidewall 780 from one another. The connector portion 796 includes a channel 920 defined between a pair of spaced part wall sections 806 and 808 each having a forward facing surface 810 best viewed in FIGS. 10A and 11A. Returning to FIG. 11A, the connector portion 797 includes a recess or an aperture 812 adjacent to a forward facing surface 814 best viewed in FIG. 11A.

The body 620 includes a skirt 830 disposed about an outside portion of the sidewall 780 extending rearwardly beyond the rearward opening portion 790 of the sidewall 780. The skirt 830 is configured to receive the first (vertical) substrate 680 (see FIG. 10B) and allow the first (vertical) substrate 680 to abut the rearward opening portion 790 of the sidewall 780. In this manner, the first (vertical) substrate 680 (see FIG. 10B) closes the rearward opening portion 790 and cuts off access to the interior receptacle 782 through the rearward opening portion 790. Optionally, the skirt 830 includes a cutout portion 834 adjacent each of the connector portions 794 and 795 to allow access thereto. The skirt 830 prevents the first (vertical) substrate 680 (see FIG. 10A) from moving laterally relative to the rearward opening portion 790 of the sidewall 780 and thereby helps maintain the first (vertical) substrate 680 in engagement with the rearward opening portion 790 of the sidewall 780. Optionally, the skirt 830 may be configured to receive at least a portion of the terminal block 600 (see FIG. 10A). However, this is not a requirement.

Figure 11B:
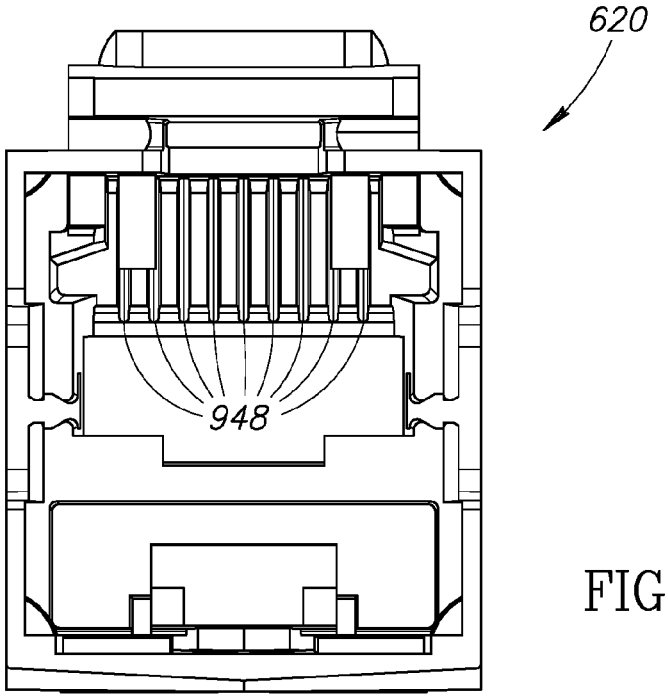
FIG. 11B is a rear view of the body of the outlet of FIG. 1A.

Turning to FIG. 11B, in the embodiment illustrated, the body 620 includes dividers 948 configured to fit between adjacent ones of the outlet contacts 640 (see FIGS. 10A and 10B) that help maintain the lateral spacing of the outlet contacts 640 and their electrical isolation from one another.

Turning to FIG. 10B, when the body 620 and the terminal block 600 are connected together, the first (vertical) substrate 680 is sandwiched therebetween and held in place against the rearward opening portion 790 (see FIG. 11A) of the sidewall 780 (see FIG. 11A) by the terminal block 600.

Figure 11C:
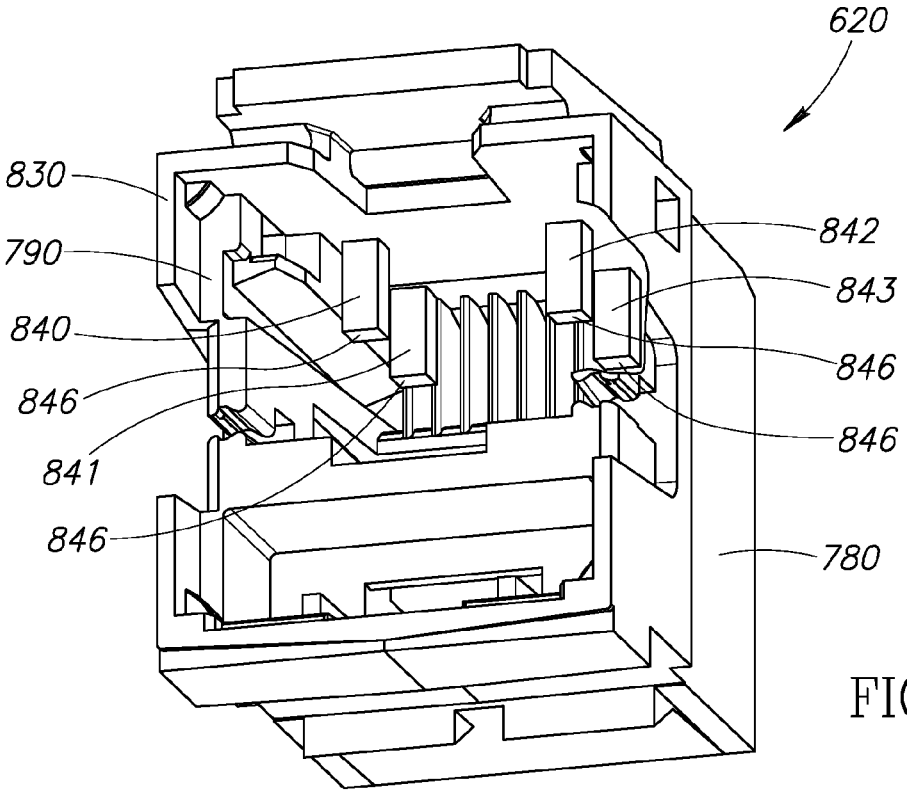
FIG. 11C is a perspective view of the rearwardly facing portion of the body of the outlet of FIG. 1A taken from below the body.

Turning to FIG. 11C, optionally, the body 620 may include one or more retaining structures (e.g., a plurality of downwardly extending members 840-843) configured to position the second (horizontal) substrate 700 (see FIGS. 10A and 10B) relative to the outlet contacts 640, and help prevent the second (horizontal) substrate 700 from sliding inside the interior receptacle 782 along with the switch 220 when the switch 220 is moved. In the embodiment illustrated, the second (horizontal) substrate 700 is affixed (e.g., adhered) to a downward facing surface 846 of each of the downwardly extending members 840-843. In FIG. 11C, a portion of the skirt 830 and the sidewall 780 adjacent the downwardly extending members 842 and 843 has been removed to provide a better view of the downwardly extending members 842 and 843. In alternate embodiments, instead of the downwardly extending members 840-843, the body 620 may include a recess or pocket (not shown) configured to receive and retain the second (horizontal) substrate 700. Optionally, the second (horizontal) substrate 700 may be affixed (e.g., adhered) inside the pocket (not shown).

Returning to FIG. 11A, the body 620 includes a pair of spaced apart channels 850 and 852. Each of the channels 850 and 852 includes an upward opening through-slot 854. The channels 850 and 852 each includes a forward facing exit aperture 856 opposite a closed end portion 858. In the embodiment illustrated, the channels 850 and 852 are formed in a transverse support 860 that extends through the interior receptacle 782 between opposite sides of the sidewall 780.

Optionally, the body 620 may include one or more connector portions 870 configured to (removably or permanently) attach the outlet 120 inside an aperture (not shown) formed in an external structure (not shown). For example, the connector portions 870 may be used to attach the outlet 120 inside an aperture (not shown) formed in a patch panel, rack, wall outlet, and the like.

Turning to FIG. 10C, in the embodiment illustrated, the outlet contacts 640 include the eight individual outlet contacts 641-648, which correspond to the eight plug contacts 341-348 (see FIG. 5C), respectively. Through application of ordinary skill in the art to the present teachings, embodiments including different numbers of outlet contacts (e.g., 4, 6, 10, 12, 16, etc.) may be constructed for use with plugs having different numbers of plug contacts.

Figure 12:
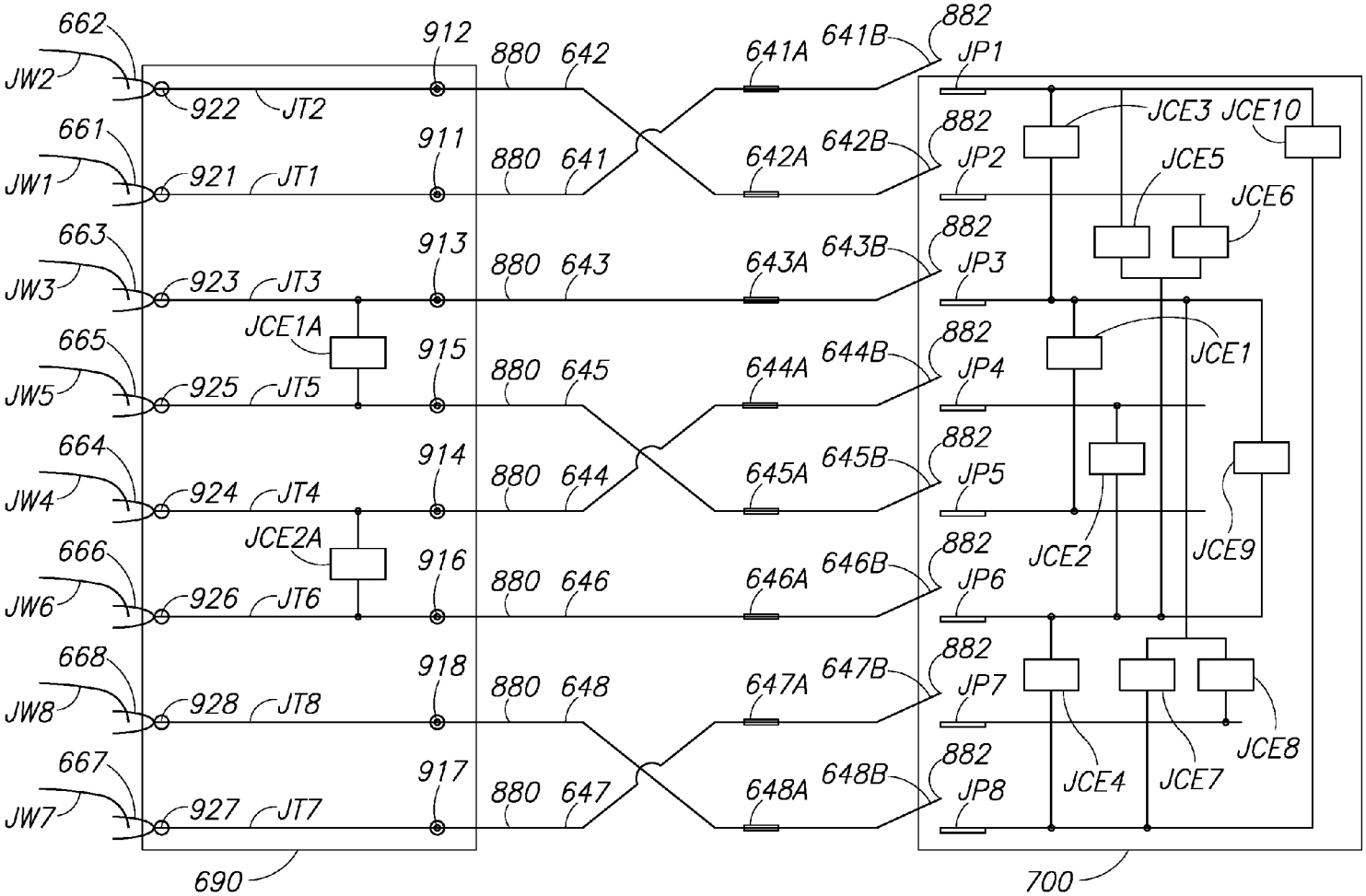
FIG. 12 is a representative electrical circuit diagram of the electrical components of the outlet of FIG. 1A.

Each of the outlet contacts 641-648 has a first end portion 880 configured to be fixedly attached to the first (vertical) substrate 680, and a second, free end portion 882 opposite the first end portion 880. The second, free end portions 882 are arranged in the interior receptacle 782 (see FIG. 7A) of the body 620 such that a section of free end portions 882 of each of the contacts 641-648, such sections designated as 641A-648A as shown in FIGS. 10C, 10D, and 12, are made available to contact the plug contacts 341-348, respectively, of the plug 100 when the plug is inserted into the outlet 120. Similarly these portions 641A-648A of free end portions 882 of contacts 641-648 would likewise be available to contact the spade contacts of a conventional plug, 401-408, such as the ones shown in FIG. 6.

The outlet 120's contacts 641-648 may be configured to provide coupling for enhanced mated connector performance. For example, in the embodiment illustrated, the outlet contact 641 crosses (e.g. swaps position with) the outlet contact 642, the outlet contact 644 crosses (e.g. swaps position with) the outlet contact 645, and the outlet contact 647 crosses (e.g. swaps position with) the outlet contact 648.

Such contact routing may also be described as positioning the outlet contact 641 such that the outlet contact 641 is exposed to the outlet contact 643, positioning the outlet contact 644 such that the outlet contact 644 is exposed to the outlet contact 646, positioning the outlet contact 645 such that the outlet contact 645 is exposed to the outlet contact 643, and positioning the outlet contact 648 such that the outlet contact 648 is exposed to the outlet contact 646. Positioning of the outlet tines 641-648 as outlined above provides for both capacitive and inductive coupling between selective tine combinations. This routing of the outlet contacts 641-648 helps compensate for unequal exposure of electrically conductive elements in the plug 100 to one another. It is preferable to position this routing as close as possible to the location where the plug 100 forms an electrical connection with the outlet 120 (e.g. 641A-648A as can be seen in FIGS. 10C, 10D, and 12), or the conventional outlet 140 illustrated in FIG. 1B. Additional and/or alternate tine routing/coupling techniques may be used.

In addition to tine coupling, addition couplings can be implemented at various locations in the outlet 120 to provide even further enhanced mated connector performance. FIG. 12 illustrates a representative electrical circuit diagram of the electrical components of the outlet 120. The second, free end portion 882 of each of the outlet contacts 641-648 includes plug contact portions 641A-648A and switch contact portions 641B-648B (see FIGS. 10C, 10D, and 12). In the embodiment illustrated, the switch contact portions 641B-648B are located distally relative to the plug contact portions 641A-648A. The plug contacts 341-348 (see FIG. 5C) of the plug 100 contact the outlet contacts 641-648 along their respective contact portions. Similarly, when the conventional plug 160 (see FIG. 1C) is inserted into the outlet 120, the spade-shaped contacts 401-408 (see FIG. 6) contact the outlet contacts 641-648 along their plug contact portions 641A-648A, respectively.

Returning to FIG. 10C, the second (horizontal) substrate 700 has a first side 890 opposite a second side 892. The substrate 700 may also include additional internal layers capable of being configured with various conductive elements. Contact pads (e.g., conductive pads) JP1-JP8 are located on the first side 890 of the second (horizontal) substrate 700 which is positioned immediately above the switch contact portions 641B-648B (see FIG. 12) of the outlet contacts 641-648. The outlet contacts 641-648 are configured to bias their switch contact portions 641B-648B (see FIGS. 10C, 10D, and 12) toward and into contact with the contact pads JP1-JP8, respectively.

Turning to FIG. 12, certain combination of contact pads JP1-JP8 are selectively coupled by coupling elements JCE1-JCE9 positioned on the first side 890 of the second (horizontal) substrate 700. In the embodiment illustrated, element JCE1 couples contact pads JP3 and JP5, element JCE2 couples contact pads JP4 and JP6, element JCE3 couples contact pads JP3 and JP1, element JCE4 couples contact pads JP6 and JP8, element JCE5 couples contact pads JP6 and JP1, element JCE6 couples contact pads JP6 and JP2, element JCE7 couples contact pads JP3 and JP8, element JCE8 couples contact pads JP3 and JP7, element JCE9 couples contact pads JP3 and JP6.

The coupling elements JCE1-JCE9 are configured to provide coupling at the switch contact portions 641A-648A of the outlet contacts 641-648 when operating in the second (legacy) mode. While these couplings are applied at the switch contact points 641A-648A, it is understood by those of ordinary skill in that art that these couplings electrically interact with all other couplings associated with the outlet contacts 641-648 and any of their associated circuitry, including any coupling associated with the circuitry of any plug that is mated with the outlet.

In the case of a legacy plug 160, FIG. 1C, and this plug's associated circuitry (see FIG. 6), such couplings help enable the outlet 120 to achieve the desirable overall electrical performance when operating in the second (legacy) mode and mated with a legacy plug 160.

While these couplings contain primarily capacitive coupling, they may also contain small amounts of other forms of coupling, such as conductive and inductive.

Small amounts of additional optional coupling may be provided on substrate 700 between any combinations of contact pads JP1-JP8. One non-limiting example of such optional coupling is JCE9 which may be located between JP1 and JP8. As with coupling JCE1-JCE8, these additional optional coupling(s) enable the outlet 120 to achieve the desirable overall electrical performance when operating in the second (legacy) mode.

Additional outlet couplings designed to enhance the mated performance of the connector may also be provided on substrate 690. Such couplings may be implemented between any of the circuit board traces JT1-JT8 and at any points along the traces. Two non-limiting examples of such couplings are shown in FIG. 12 including optional coupling JCE1A, which is located between JT3 and JT5, and optional JCE2A, which is located between JT4 and JT6. These couplings may consist of any combination of capacitive, inductive or conductive coupling. It should be noted that these couplings may affect the mated performance of connectors in both the Next Gen and legacy mode since, unlike couplings JEC1-JCE9, they are not switched out of the circuit at any point.

In FIG. 12, the outlet 120 is illustrated operating in the first (Next Gen) mode. In this mode, the outlet contacts 641-648 do not contact the contacts JP1-JP8. In contrast, in the second (legacy) mode, the outlet contacts 641-648 contact the contacts JP1-JP8, respectively, and form electrical connections therewith.

Turning to FIG. 10E, the wire contacts 660 include a separate wire contact for each of the outlet contacts 640. Thus, in the embodiment illustrated, the wire contacts 660 include the eight wire contacts 661-668. The wire contacts 661-668 correspond to the outlet contacts 641-648, respectively. The wire contacts 661-668 also correspond to the wires JW1-JW8, respectively, of the cable C2. Each of the wire contacts 660 may be implemented as an insulation displacement connector ("IDC"). However, this is not a requirement and embodiments in which the wire contacts 660 are implemented in another manner are also within the scope of the present teachings. Wire contacts, such as wire contacts 660, used in communication jacks are well known in the art and will not be described in detail herein.

The first (vertical) substrate 680 has a first forwardly facing side 900 opposite a second rearwardly facing side 902. As may be viewed in FIG. 12, the first (vertical) substrate 680 includes circuit paths or traces JT1-JT8 formed on one or both of the first and second sides 900 and 902 of the first substrate 680. The traces JT1-JT8 electrically connect the outlet contacts 641-648, respectively, to the wire contacts 661-668, respectively. The first (vertical) substrate 680 includes apertures 911-918 (e.g., plated through-holes) configured to receive the first end portion 880 (see FIG. 10C) of the outlet contacts 641-648, respectively, and electrically connect the outlet contacts 641-648 to the traces JT1-JT8, respectively. The first (vertical) substrate 680 also includes apertures 921-928 (e.g., plated through-holes) configured to receive each of the wire contacts 661-668, respectively, and electrically connect the wire contacts 661-668 to the traces JT1-JT8, respectively. While exemplary structures for electrically connecting the outlet contacts 641-648 to the wire contacts 661-668, respectively, have been described, alternate means may be used to electrically connect the outlet contacts 641-648 to the wire contacts 661-668, respectively.

Returning to FIG. 10E, in the embodiment illustrated, the first end portions 880 (see FIG. 10C) of the outlet contacts 641-648 may be pressed into the apertures 911-918 from the first forwardly facing side 900 of the first (vertical) substrate 680 and the wire contacts 661-668 may be pressed into the apertures 921-928, respectively, in the first (vertical) substrate 680 from the second rearwardly facing side 902 of the first (vertical) substrate 680. Thus, the outlet contacts 641-648 (see FIG. 10C) and wire contacts 661-668 extend away from the first (vertical) substrate 680 in opposite directions. The outlet contacts 641-648 may be subsequently soldered into place, if desired.

Returning to FIGS. 10A and 10B, the switch 220 includes a movable insulator 930, and one or more biasing members 940 and 942. The insulator 930 is configured to be spaced apart from and slide with respect to the first side 890 (see FIG. 10C) of the second (horizontal) substrate 700.

Turning to FIG. 10C, the insulator 930 has a substantially planar upper portion 950 and one or more supports 954 and 956 that extend away from the upper portion 950.

As can be best seen in FIG. 10C, the upper portion 950 has a forwardly projecting insulating portion 958 configured to fit between the outlet contacts 641-648 and the contacts JP1-JP8. In the embodiment illustrated, the insulating portion 958 has a tapered distal edge portion 960 configured to provide an inclined plane upon which the switch contact portions 641B-648B (see FIG. 12) of the outlet contacts 641-648 may slide along and away from the contacts JP1-JP8.

Figure 8A:
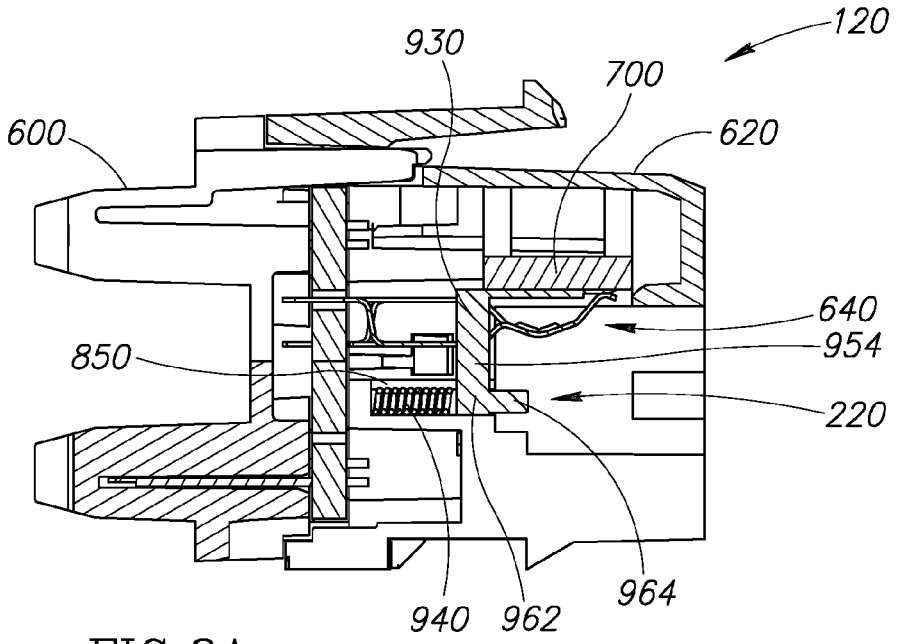
FIG. 8A is a cross sectional view of the outlet of FIG. 1A operating in the first mode taken along line F-F in FIG. 7C.
Figure 8B:
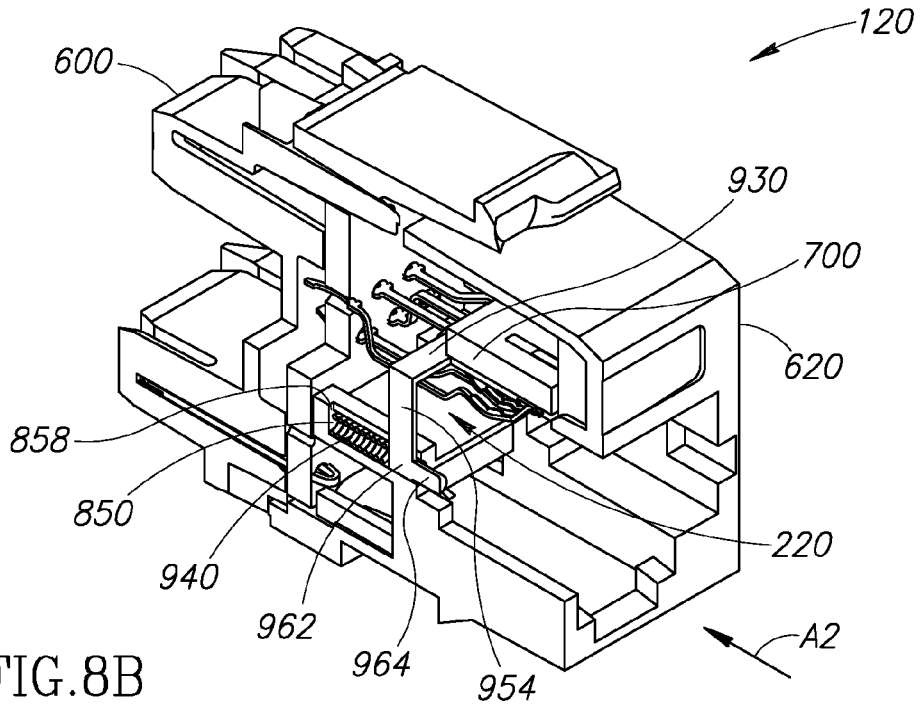
FIG. 8B is a perspective view of the cross section of FIG. 8A.
Figure 9A:
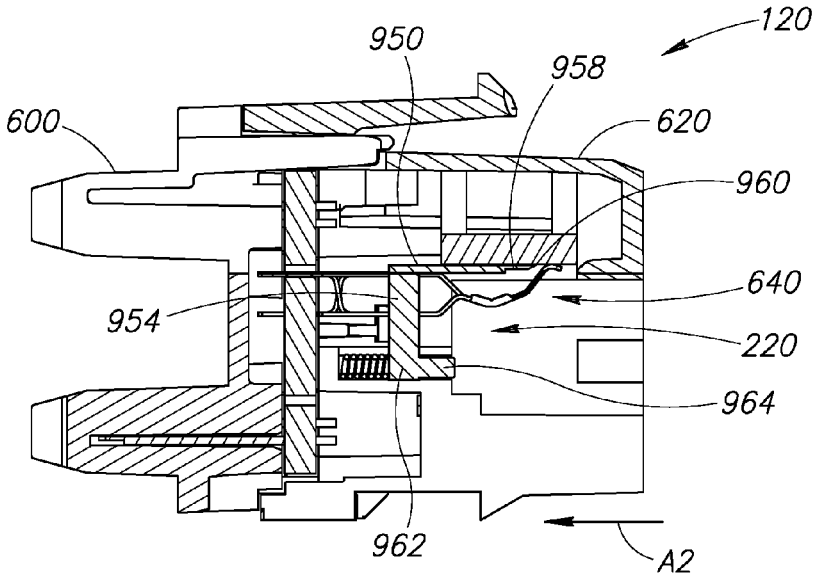
FIG. 9A is a cross sectional view of the outlet of FIG. 1A operating in the second mode taken along line F-F in FIG. 7C.
Figure 9B:
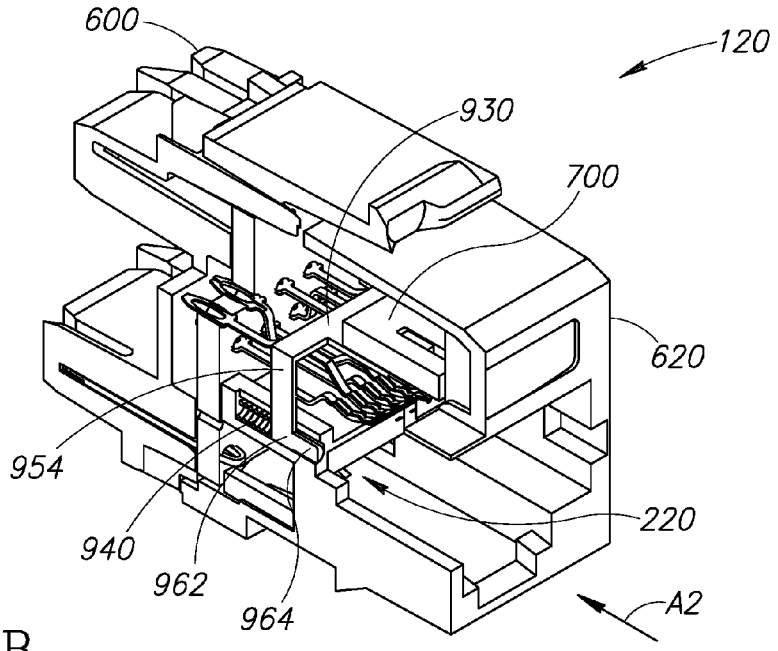
FIG. 9B is a perspective view of the cross section of FIG. 9A.

Each of the supports 954 and 956 has a distal portion 962 configured to be received inside the channels 850 and 852 (see FIG. 11A), respectively of the body 620. In the embodiment illustrated, the distal portions 962 each have a substantially circular cross-sectional shape. However, this is not a requirement. Turning to FIGS. 8A and 8B, the biasing members 940 and 942 are configured to be positioned inside the channels 850 and 852 (see FIG. 11A), respectively. Inside the channel 850, the biasing members 940 is positioned between the closed end portion 858 of the channel 850 and the distal portion 962 of the support 954. Similarly, inside the channel 852, the biasing members 942 is positioned between the closed end portion 858 of the channel 852 and the distal portion 962 of the support 956. The biasing members 940 and 942 exert a biasing force on the distal portions 962 of the supports 954 and 956, respectively. In the embodiment illustrated, each of the biasing members 940 and 942 have been implemented as coil springs. Thus, the biasing members 940 and 942 may be compressed between the closed end portions 858 of the channels 850 and 852 and the distal portions 962 of the supports 954 and 956, respectively.

In the embodiment illustrated, a projection 964 extends forwardly from the distal portion 962 of each of the supports 954 and 956. Referring to FIGS. 8A-9B, the projections 964 of the supports 954 and 956 extend outwardly from the channels 850 and 852, respectively, through the exit apertures 856 (see FIG. 11A) of the channels 850 and 852. The projections 964 may extend forwardly from the channels 850 and 852 when the outlet 120 is in either the first (Next Gen) mode or the second (legacy) mode. Thus, the projections 964 are positioned inside the interior receptacle 782. The projections 964 are configured to be received inside the openings 331 and 333 (see FIG. 3A) in the housing 380 of the plug 100. The openings 331 and 333 are configured to receive the projections 964 and allow them to pass unimpeded into the channels 330 and 332 formed in the forward facing portion 326 of the housing 380. The projections 964 are configured to travel freely through the channels 786 and 788 unimpeded. Thus, the housing 380 of the plug 100 avoids exerting a rearward force (e.g., in a direction opposite a direction identified by an arrow A2 in FIGS. 8A-9B) on the projections 964 when the plug 100 is inserted inside the outlet 120.

The insulator 930 is selectively movable with respect to the second (horizontal) substrate 700 and the housing 740 between an insulating position (see FIGS. 4A, 8A, and 8B) and a non-insulating position (see FIGS. 4B, 9A, 9B, and 10C). In the insulating position, the insulating portion 958 (see FIG. 10C) of the insulator 930 is positioned between the switch contact portions 641B-648B (see FIG. 12) of the outlet contacts 641-648 and the contacts JP1-JP8 (see FIG. 10C) to insulate the contacts from the switch contact portions 641B-648B of the outlet contacts 641-648. As illustrated in FIG. 8A, in this configuration, the switch contact portions 641B-648B of the outlet contacts 640 rest upon the insulating portion 958 (see FIG. 10C) of the insulator 930 and are spaced apart from the contacts JP1-JP8. Turning to FIG. 10C, when the insulator 930 is in the non-insulating position, the insulating portion 958 of the insulator 930 is not between the switch contact portions 641B-648B (see FIG. 12) of the outlet contacts 640 and the contacts JP1-JP8. In this configuration, the outlet contacts 641-648 bias the switch contact portions 641B-648B of the outlet contacts 641-648 into contact with the contacts JP1-JP8, respectively. Thus, when the insulator 930 is in the non-insulating position, an electrical connection is formed between the outlet contacts 641-648 and the contacts JP1-JP8, respectively.

Turning to FIGS. 8A and 8B, the biasing force exerted by the biasing members 940 and 942 on the distal portions 962 of the supports 954 and 956, respectively, biases the insulator 930 toward the insulating position. When the insulator 930 is in the non-insulating position, the biasing members 940 and 942 are compressed between the closed end portion 858 of the channels 850 and 852 and the distal portions 962 of the supports 954 and 956, respectively.

The biasing members 940 and 942 are configured to bias the insulator 930 into the insulating position when the plug 100 is inserted into the outlet 120. When the insulator 930 is in the insulating position, the additional coupling provided by the coupling elements JCE1-JCE9 (see FIG. 12) is not utilized. This places the outlet 120 in the first (Next Gen) mode.

The biasing members 940 and 942 are configured to apply a biasing force (in the direction opposite the direction identified by the arrow A2) to the insulator 930 that positions the insulator in the insulating position. However, an external force exerted on the projections 964 (in the direction identified by the arrow A2) may overcome the biasing force applied to the insulator 930 by the biasing members 940 and 942. Thus, when sufficient external force is applied to the projections 964, the insulator 930 is transitioned to the non-insulating position. When the insulator 930 is in the non-insulating position, the additional coupling provided by the coupling elements JCE1-JCE9 (see FIG. 12) is utilized. This places the outlet 120 in the second (legacy) mode.

As will be described below, the configuration of a conventional plug (e.g., the conventional plug 160 illustrated in FIG. 1C) exerts sufficient force on the projections 964 when the conventional plug is inserted into the outlet 120 to transition the insulator 930 to the non-insulating position thereby placing the outlet 120 in the second (legacy) mode. On the other hand, the plug 100 does not exert force on the projections 964. Instead, the projections 964 of the insulator 930 are received inside the channels 330 and 332 (see FIG. 3A) via the openings 331 and 333 (see FIG. 3A). Thus, the insulator 930 remains in the insulating position and the outlet 120 remains in the first (Next Gen) mode when the plug 100 is inserted into the outlet 120.

As defined above and depicted generally in FIG. 12, the three regions of couplings potentially available in outlet 120 are the coupling provided by the contacts 641-648, the coupling provided by the coupling elements JCE1-JCE8 located on substrate 700, and optional coupling elements JCE1A and JCE2A located on substrate 690.

When outlet 120 is used in the second (legacy) mode (as would be the case when mated with a conventional RJ-45 plug), all three regions of coupling are connected into the overall circuit. In this mode, the outlet/plug mated performance equals the mated performance specified for the Category of the plug with which the outlet is mated. For example, if outlet 120 is mated with a Category 6A plug, then mated performance would be that of Category 6A. If the outlet is mated with a Category 6 plug, then the mated performance would be that of Category 6, etc.

When the outlet is used in the first (Next Gen) mode (as would be the case when mated with a Next Gen/Category 8 plug (configured herein as plug 100)), then only the coupling provided by the contacts 641-648 and the coupling provided on substrate 690 are connected into the overall circuit with the exception that coupling elements CE1-CE8 in the plug would not be connected into the overall circuit. In this mode, the mated performance of the outlet/plug connection would be the Category 8 mated connector electrical performance requirements specified herein.

For the Next Gen/Category 8 outlet (configured herein as outlet 120), all circuit elements are designed to meet Next Gen/Category 8 mated connector performance when mated with a Next Gen/Category 8 plug (configured herein as plug 100), and the corresponding performance of a conventional RJ-45 type plug when mated with such a plug.

For the Next Gen/Category 8 plug (configured herein as plug 100), all circuit elements are designed to meet Next Gen/Category 8 mated connector performance when mated with a Next Gen/Category 8 outlet (configured herein as outlet 120), and the corresponding performance of a conventional RJ-45 type outlet when mated with such an outlet.

Examples of Possible Mated Connections

Table C below lists the possible mated connections that may be formed using the plug 100 or plug 160 and the outlet 120 or outlet 140. Each row of the Table C lists a different type of mated connection. In the Table C, the term "conventional" refers to Categories 1, 2, 3, 4, 5, 5e, 6, or 6A and the term "Next Generation" refers to the standard used to construct the plug 100 and the outlet 120. In Table C, the first column (labeled "Outlet Standard") identifies the standard with which the outlet used in the connection complies. For example, the outlet may be the outlet 120, which is constructed according to the Next Generation standard, or the conventional outlet 140 (see FIG. 1B), which is constructed according to the conventional standard (e.g., the Categories 1, 2, 3, 4, 5, 5e, 6 or 6A standards). The second column (labeled "Plug Standard") identifies the standard with which the plug used in the connection complies. For example, the plug may be the plug 100, which is constructed according to the Next Generation standard, or the conventional plug 160 (see FIG. 1C) which is constructed according to the conventional standard (e.g., the Categories 1, 2, 3, 4, 5, 6 or 6A standard). The third column (labeled "Plug Circuit Coupling (CE1-CE8)), indicates whether these couplings are connected or disconnected to the plug's overall circuit where applicable. Note that in the case of a conventional plug such as plug 160 (see FIG. 1C), these specific couplings do not exist, and therefore any connection made with a conventional plug has "not applicable" in this column. The fourth column (labeled "Outlet Circuit Coupling (JCE1-JCE10)"), indicates whether these couplings are connected or disconnected to the outlet's overall circuit where applicable. Note that in the case of a conventional outlet such as outlet 140 (see FIG. 1B), these specific couplings do not exist, and therefore any connection made with a conventional plug would have "Not Applicable" in this column. The last column (labeled "Mated Connection Performance") identifies the standard with which the mated connection complies.

TABLE C

| Plug Standard | Outlet Standard | Plug Circuit Coupling (CE1-CE8) | Outlet Circuit Coupling (JCE1-JCE10) | Mated Connection Performance |
|---|---|---|---|---|
| Next Generation | Next Generation | Disconnected | Disconnected | Next Generation |
| Next Generation | Conventional | Connected | Not Applicable | Conventional (same as outlet) |
| Conventional | Next Generation | Not Applicable | Connected | Conventional (same as plug) |

Mated Connection Formed with the Plug 100 and Outlet 120

FIGS. 1A and 13A depict the connection 10 of the type listed in the first row of the Table C. These FIGS. illustrate a mated connection formed by the (Next Generation) outlet 120 and the (Next Generation) plug 100.

Turning to FIG. 13A, as mentioned above, when the plug 100 is inserted into the interior receptacle 782 (see FIG. 7A) of the outlet 120, the outwardly extending projections 528 and 530 (see FIG. 5A) of the plug 100 are received inside the forwardly opening recesses 786 and 788 of the body 620 of the outlet 120. Thus, the outlet 120 does not exert force on the outwardly extending projections 528 and 530 and the insulator 500 (see FIG. 5A) of the plug 100 remains in the insulating position (see FIG. 2C). Because the insulator 500 is in the insulating position, the plug 100 operates in the first (Next Gen) mode when inserted into the outlet 120. As indicated in Table C, plug circuit coupling provided by the coupling elements CE1-CE8 (see FIG. 5D) of the plug 100 is disconnected because the insulating portion 520 (see FIG. 5E) of the insulator 500 insulates the contact pads P1-P8 (connected to the coupling elements CE1-CE8 illustrated in FIG. 5D) from the plug switch contacts 341B-348B (see FIG. 5D), respectively.

Further, the projections 964 (see FIG. 10C) of the outlet 120 are received inside the channels 330 and 332 (see FIG. 3A) via the openings 331 and 333 (see FIG. 3A) of the plug 100. Thus, no external force is applied to the projections 964 to overcome the biasing force applied to the insulator 930 by the biasing members 940 and 942. Therefore, the biasing members 940 and 942 bias the insulator 930 into the insulating position. Because the insulator 930 is in the insulating position, the outlet 120 operates in the first (Next Gen) mode when the plug 100 is received inside the outlet 120. As indicated in Table C, coupling provided by the coupling elements JCE1-JCE7 (see FIG. 12) of the outlet 120 is disconnected because the insulating portion 958 of the insulator 930 insulates the contacts JP1-JP8 (connected to the coupling elements JCE1-JCE7) from the contacts 641-648 (see FIG. 12), respectively.

Thus, both the plug 100 and the outlet 120 operate in the first (Next Gen) mode in the connection 10.

Mated Connection Formed with the Plug 100 and Conventional Outlet

FIGS. 1B and 13B depict the exemplary connection 20 of the type listed in the middle row of the Table B. These FIGS. illustrate a mated connection formed by the conventional outlet 140 (constructed according to the Categories 1, 2, 3, 4, 5, 5e, 6 or 6A standard), and the (Next Generation) plug 100.

Table C indicates coupling provided by the conventional outlet 140 is "Not Applicable." This does not mean that the conventional outlet 140 does not include some form of circuit coupling. Instead, this merely indicates that because the conventional outlet 140 different from the circuit coupling provided in outlet 120 and is not switchable in and out of the outlet's overall circuitry, its circuit coupling remains constant no matter which plug is inserted into the conventional outlet. The term "Not Applicable" has been chosen to indicate that whatever circuit coupling may be present in the conventional outlet 140, the circuit coupling cannot be selectively connected and disconnected.

Turning to FIG. 13B, the conventional outlet 140 includes a dielectric housing or body 1000. The body 1000 includes a sidewall 1002 defining an interior receptacle 1004 configured to receive the forward portion 316 of the housing 740 of the plug 100 (as well as a forward portion 1032 of a housing 1030 of the conventional plug 160 illustrated in FIG. 13D). The sidewall 1002 includes a frontward opening portion 1006 in communication with the interior receptacle 1004.

The frontward opening portion 1006 of the sidewall 1002 of the conventional outlet 140 engages the outwardly extending projections 528 and 530 of the plug 100 and presses them rearwardly (in the direction identified by the arrow A1) when the forward portion 316 of the housing 740 of the plug 100 is inserted into the interior receptacle 1004 of the conventional outlet 140. The force exerted by the frontward opening portion 1006 of the sidewall 1002 is sufficient to transition the insulator 500 (see FIGS. 5A and 5B) of the plug 100 into the non-insulating position (see FIGS. 3A-3D) thereby placing the plug 100 in the second (legacy) mode. Thus, the plug 100 is automatically transitioned from the first (Next Gen) mode to the second (legacy) mode merely by inserting the plug 100 into the conventional outlet 140.

Turning to FIG. 5D, as indicated in Table C, coupling provided by the coupling elements CE1-CE8 (see FIG. 5D) of the plug 100 is connected because the insulating portion 520 (see FIG. 5E) of the insulator 500 does not insulate the contact pads P1-P8 (connected to the coupling elements CE1-CE8) from the plug switch contacts 341B-348B, respectively.

Mated Connection Formed with the Outlet 120 and Conventional Plug

Figure 13C:
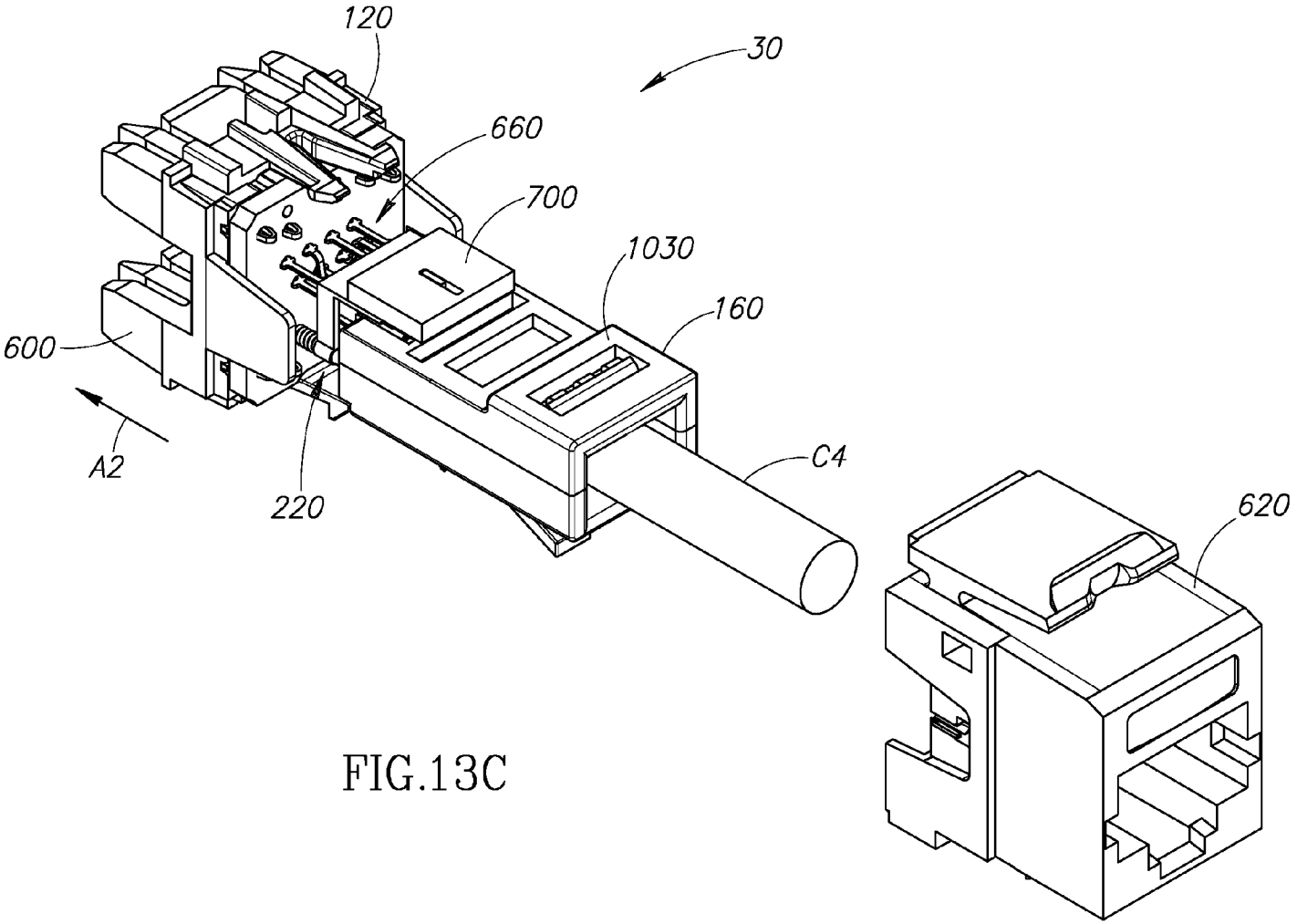
FIG. 13C is a perspective view of the connection of FIG. 1C with the body exploded from the outlet.

FIGS. 1C and 13C depict the exemplary connection 30 of the type listed in the last row of the Table B. These FIGS. illustrate a connection formed by the (Next Generation) outlet 120 and the (conventional) plug 160 (constructed according to the Categories 1, 2, 3, 4, 5, 5e, 6 or 6A standard).

Table C indicates circuit coupling provided by the conventional plug 160 is "Not Applicable." This does not mean that the conventional plug 160 does not include some form of circuit coupling. Instead, this merely indicates that the conventional plug 160 has circuit coupling that is different than the circuit coupling provided in plug 100, and that it is not switchable in and out of the plug's overall circuitry, its circuit coupling remains constant independent of the outlet into which the conventional plug 160 is inserted. The term "Not Applicable" has been chosen to indicate that whatever circuit coupling may be present in the conventional plug 160, the circuit coupling cannot be selectively connected and disconnected.

Figure 13D:
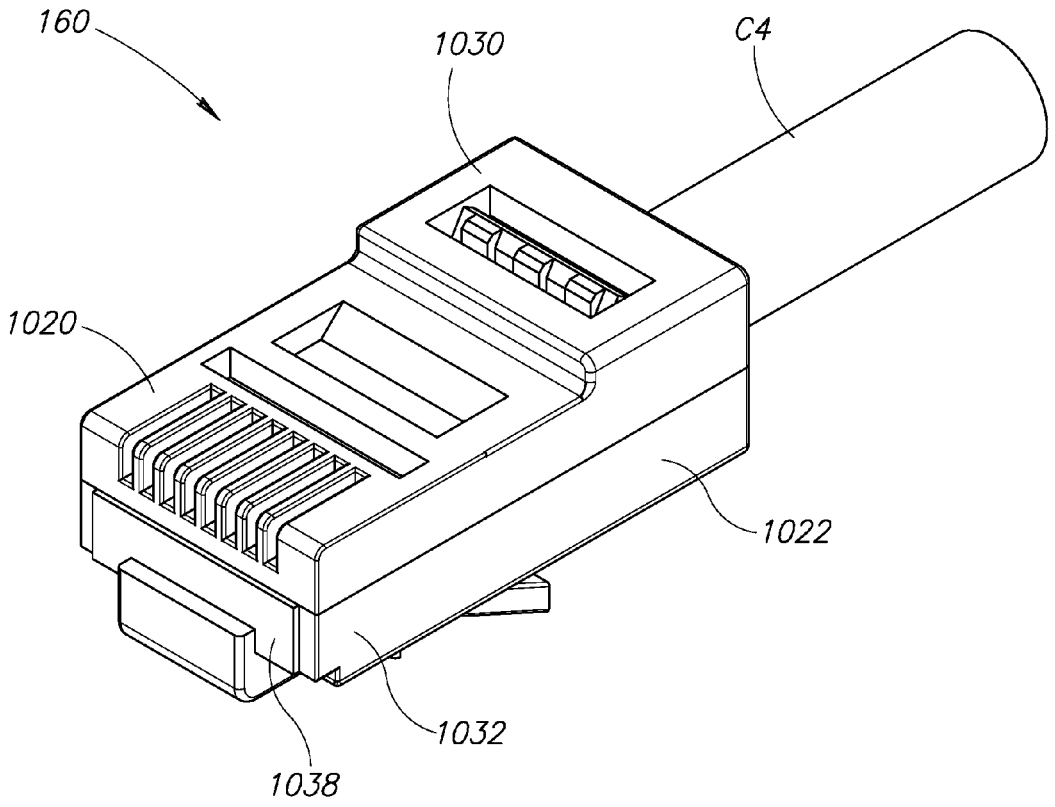
FIG. 13D is a perspective view of a front portion of the conventional plug of FIG. 1C.

Turning to FIG. 13D, the conventional plug 160 includes a cover portion 1020 and a body portion 1022. The cover portion 1020 is configured to be attached to the body portion 1022 to form a conventional RJ-45 type plug housing 1030 configured to house the spade-shaped contacts 401-408 (see FIG. 6). The housing 1030 has a forward portion 1032 configured to be received by an outlet (e.g., the outlet 120 illustrated in FIG. 1A, the legacy outlet 140 illustrated in FIG. 1B, and the like). In the embodiment illustrated, the forward portion 1032 has a forward facing portion 1038. Unlike the forward facing portion 326 (see FIG. 3A) of the housing 380 (see FIG. 3A) of the plug 100, the forward facing portion 1038 of the housing 1030 of the conventional plug 160 does not include forward facing openings into channels. Thus, projections 964 of outlet 120 engage (abut) the forward facing portion 1038 of housing 1030 of the conventional plug 160 when the conventional plug 160 is inserted into the outlet 120.

When the projections 964 of the outlet 120 engage (abut) the forward facing portion 1038 of the housing 1030 of the conventional plug 160, the forward facing portion 1038 presses the projections 964 rearwardly (in the direction identified by the arrow A2). The force exerted by the forward facing portion 1038 of the housing 1030 is sufficient to transition the insulator 930 (see FIGS. 10A and 10B) of the outlet 120 into the non-insulating position (see FIGS. 9A and 9B) thereby placing the outlet 120 in the second (legacy) mode. In other words, the force exerted by the forward facing portion 1038 of the housing 1030 is sufficient to overcome the biasing force applied to the insulator 930 by the biasing members 940 and 942. Thus, the outlet 120 is automatically transitioned from the first (Next Gen) mode to the second (legacy) mode merely by inserting the conventional plug 160 into the conventional outlet 140.

Turning to FIG. 12, as indicated in Table B, circuit coupling provided by the coupling elements JCE1-JCE10 of the outlet 120 is connected because the insulating portion 958 of the insulator 930 does not insulate the contact pads JP1-JP8 (connected to the coupling elements JCE1-JCE10) from the switch contacts 641B-648B, respectively.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those of ordinary skill in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those of ordinary skill in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A communication plug for use with a cable, a first corresponding communication outlet, and a second corresponding communication outlet, the cable comprising a plurality of wires, the first corresponding communication outlet being configured to mate with the communication plug to form a first connection therewith, the second corresponding communication outlet being configured to mate with the communication plug to form a second connection therewith, the second corresponding communication outlet comprising at least one aperture, the communication plug comprising:

a substrate comprising a plurality of plated through-holes, a plurality of circuit paths, and a plurality of contact pads, each of the plurality of plated through-holes being configured to receive a corresponding one of the plurality of wires, a plurality of plug contacts mounted on the substrate, a different one of the plurality of circuit paths connecting each of the plurality of plug contacts to a different one of the plurality of plated through-holes, the plurality of contact pads comprising a different contact pad corresponding to each of the plurality of plug contacts, at least a portion of the plurality of contact pads being connected to one or more coupling elements, each of the plurality of plug contacts being positioned to contact the contact pad corresponding to the plug contact; and an insulator comprising an insulating portion and at least one projection, the insulating portion being adjacent the plurality of contact pads, the at least one projection being configured to transition the insulator from a first one of an insulating position and a non-insulating position to a different second one of the insulating position and the non-insulating position, the insulating portion of the insulator insulating the plurality of contact pads from the plurality of plug contacts when the insulator is in the insulating position, the plurality of plug contacts contacting the plurality of contact pads when the insulator is in the non-insulating position, the first corresponding communication outlet pressing against the at least one projection when the first corresponding communication outlet is mated with the communication plug thereby causing the at least one projection to automatically transition the insulator, and the at least one projection being received inside the at least one aperture of the second corresponding communication outlet when the second corresponding communication outlet is mated with the communication plug such that the second corresponding communication outlet avoids pressing against the at least one projection and avoids causing the at least one projection to transition the insulator.

2. The communication plug of claim 1, wherein the communication plug further comprises at least one biasing member exerting a biasing force on the insulator, the biasing force being sufficient to bias the insulator into the first one of the insulating position and the non-insulating position, and the at least one projection is configured to receive sufficient force to overcome the biasing force and transition the insulator from the first one of the insulating position and the non-insulating position to the different second one of the insulating position and the non-insulating position.

3. The communication plug of claim 2, further comprising:

a housing comprising an exit aperture, the housing being configured to house the substrate, the plurality of plug contacts, and at least a portion of the insulator, the at least one projection extending outwardly from inside the housing through the exit aperture.

4. The communication plug of claim 3 for use with the first corresponding communication outlet comprising a sidewall defining a receptacle configured to receive a portion of the communication plug when the communication plug and the first corresponding communication outlet are mated, wherein the at least one projection is pressed against the sidewall of the first corresponding communication outlet when the portion of the communication plug is received inside the receptacle of the first corresponding communication outlet, the pressing exerting sufficient force on the at least one projection to overcome the biasing force and transition the insulator to the second different one of the insulating position and the non-insulating position.

5. The communication plug of claim 1, wherein the plurality of plug contacts and the plurality of circuit paths are configured to carry a plurality of differential signals at a data rate of up to about 40 Gigabits per second and an operating frequency of up to about 2 Gigahertz.

6. The communication plug of claim 1, wherein the plurality of plug contacts comprise a plurality of frame spades.

7. A communication plug for use with first and second communication outlets, the first communication outlet comprising a first receptacle with a plurality of first outlet contacts, the first communication outlet being configured to operate in accordance with a first standard, the second communication outlet comprising at least one aperture and a second receptacle with a plurality of second outlet contacts, the second communication outlet being configured to operate in accordance with a second standard, the first standard being different from the second standard, the plug comprising:

a housing having a portion configured to be received inside the first receptacle of the first communication outlet and form a first connection therewith, the housing being further configured to be received inside the second receptacle of the second communication outlet and form a second connection therewith;

a coupling element subassembly configured to provide electrical coupling in accordance with the first standard;

a plurality of plug contacts positioned inside the housing, the plurality of plug contacts being contactable through apertures in the housing by the plurality of first outlet contacts when the plug is received inside the first receptacle of the first communication outlet, and by the plurality of sec outlet contacts when the plug is received inside the second receptacle of the second communication outlet; and a switch assembly having at least one projecting portion, the first communication outlet pressing on the at least one projecting portion and causing the switch assembly to move allowing the plurality of plug contacts to contact the coupling element subassembly when the plug is inserted into the first receptacle of the first communication outlet, the at least one aperture of the second communication outlet receiving the at least one projecting portion and avoiding pressing on the switch assembly thereby allowing the plurality of plug contacts to remain disconnected from the coupling element subassembly when the plug is inserted into the second receptacle of the second communication outlet.

8. The plug of claim 7, wherein the plurality of plug contacts comprise a plurality of frame spades.

9. The plug of claim 7, wherein the switch assembly slides in a first direction when the first communication outlet presses on the at least one projecting portion, the switch assembly comprises a biasing member that biases the switch assembly in a second direction, and the first direction is opposite the second direction.

10. The plug of claim 7, wherein the plug is a registered jack 45 type plug, and the first standard is Category 1, Category 2, Category 3, Category 4, Category 5, Category 5e, Category 6, or Category 6A.

11. A communication plug for use with first and second communication outlets, the first communication outlet comprising a first receptacle, the second communication outlet comprising at least one aperture and a second receptacle, the plug comprising:

an insulator comprising an insulating portion and at least one projection;

a first electrical circuit portion comprising a plurality of plug contacts; and a second electrical circuit portion, the at least one projection being received inside the at least one aperture and the insulating portion being positioned in between the plurality of plug contacts and the second electrical circuit portion when the plug is inserted into the second receptacle of the second communication outlet, the insulating portion disconnecting the first electrical circuit portion from the second electrical circuit portion when positioned in between the plurality of plug contacts and the second electrical circuit portion, the first communication outlet pressing on the at least one projection and removing the insulating portion from in between the plurality of plug contacts and the second electrical circuit portion such that the second electrical circuit portion is connected to the first electrical circuit portion when the plug is inserted into the first receptacle of the first communication outlet, the plug operating in a first electrical performance mode when the second electrical circuit portion is disconnected from the first electrical circuit portion, and the plug operating in a different second electrical performance mode when the second electrical circuit portion is connected to the first electrical circuit portion.

12. The plug of claim 11, wherein the insulator slides in a first direction when the first communication outlet presses on the at least one projection, and the plug comprises a biasing member that biases the insulator in a second direction, the first direction being opposite the second direction.

13. The plug of claim 11, wherein the second electrical circuit portion comprises electrical coupling elements that configure the plug to operate in the second electrical performance mode when the second electrical circuit portion is connected to the first electrical circuit portion.

14. A plug configured to mate one at a time with first and second outlets, the first outlet comprising a first receptacle, the second outlet comprising a second receptacle and at least one aperture, the plug comprising:

a plurality of electrical circuits;

a plurality of coupling elements that when connected to the plurality of electrical circuits electrically couple two or more of the plurality of electrical circuits together at least one of capacitively, inductively, or conductively such that the plug operates in a first electrical performance mode; and a switching mechanism having at least one projecting portion and an insulating portion, the at least one projecting portion being received inside the at least one aperture and the insulating portion being positioned to disconnect the plurality of electrical circuits from the plurality of coupling elements when the plug is inserted into the second receptacle of the second outlet, the first outlet pressing on the at least one projecting portion and moving the insulating portion such that the plurality of electrical circuits are connected with the plurality of coupling elements when the plug is inserted into the first receptacle of the first outlet, the plug operating in a different second electrical performance mode when the plurality of coupling elements are disconnected from the plurality of electrical circuits.

15. The plug of claim 14, wherein the plug and the first outlet exhibit a first mated electrical performance in accordance with a first specification when mated together, and the plug and the second outlet exhibit a different second mated electrical performance in accordance with a different second specification other than the first specification when mated together.

16. The plug of claim 15, wherein the first specification is Category 1, Category 2, Category 3, Category 4, Category 5, Category 5e, Category 6, or Category 6A.

17. A plug for use with a first outlet configured to operate in a first electrical performance mode and a second outlet configured to operate in a different second electrical performance mode, the first outlet comprising a first receptacle, the second outlet comprising at least one aperture and a second receptacle, the plug comprising:

a plurality of electrical circuits;

a plurality of coupling elements that when connected to the plurality of electrical circuits electrically couple two or more of the plurality of electrical circuits together at least one of capacitively, inductively, or conductively such that the plug operates in the first electrical performance mode; and a switching mechanism having at least one projecting portion and an insulating portion, the first outlet pressing on the at least one projecting portion and moving the insulating portion into a first position where the plurality of coupling elements are connected to the plurality of electrical circuits when the plug is inserted into the first receptacle of the first outlet, the at least one projecting portion being received inside the at least one aperture and the insulating portion being positioned to disconnect the plurality of coupling elements from the plurality of electrical circuits when the plug is inserted into the second receptacle of the second outlet, the plug operating in the second electrical performance mode when the plurality of coupling elements are disconnected from the plurality of electrical circuits.

18. The plug of claim 17, wherein the plug and the first outlet exhibit a first mated electrical performance in accordance with a first specification when the plug is inserted into the first receptacle of the first outlet and the plug is operating in the first electrical performance mode.

19. The plug of claim 18, wherein the plug and the second outlet exhibit a different second mated electrical performance in accordance with a different second specification when the plug is inserted into the second receptacle of the second outlet and the plug is operating in the second electrical performance mode.

20. The plug of claim 19, wherein the first specification is Category 1, Category 2, Category 3, Category 4, Category 5, Category 5e, Category 6, or Category 6A.

21. A communication plug for use with a cable comprising a plurality of wires, the communication plug comprising:

a substrate comprising a plurality of plated through-holes, a plurality of circuit paths, and a plurality of contact pads, each of the plurality of plated through-holes being configured to receive a corresponding one of the plurality of wires, a plurality of plug contacts mounted on the substrate, a different one of the plurality of circuit paths connecting each of the plurality of plug contacts to a different one of the plurality of plated through-holes, the plurality of contact pads comprising a different contact pad corresponding to each of the plurality of plug contacts, at least a portion of the plurality of contact pads being connected to one or more coupling elements, each of the plurality of plug contacts being positioned to contact the contact pad corresponding to the plug contact;

an insulator comprising an insulating portion and at least one projection, the insulating portion being adjacent the plurality of contact pads, the insulator being movable between an insulating position and a non-insulating position, the insulating portion of the insulator insulating the plurality of contact pads from the plurality of plug contacts when the insulator is in the insulating position, the plurality of plug contacts contacting the plurality of contact pads when the insulator is in the non-insulating position; and at least one biasing member exerting a biasing force on the insulator, the biasing force being sufficient to bias the insulator into a first one of the insulating position and the non-insulating position, the at least one projection being configured to receive sufficient force to overcome the biasing force and move the insulator from the first one of the insulating position and the non-insulating position to a second different one of the insulating position and the non-insulating position.

22. The communication plug of claim 21 for use with a first corresponding communication outlet configured to mate with the communication plug to form a connection therewith, wherein the at least one projection is configured to automatically transition the insulator when the first corresponding communication outlet is mated with the communication plug.

23. The communication plug of claim 21, further comprising:

a housing comprising first and second exit apertures, the housing being configured to house the substrate, the plurality of plug contacts, and at least a portion of the insulator, the at least one projection comprising first and second projections that extend outwardly from inside the housing through the first and second exit apertures.

24. The communication plug of claim 23 for use with a corresponding communication outlet configured to mate with the communication plug to form a connection therewith, the corresponding communication outlet comprising a sidewall defining a receptacle configured to receive a portion of the communication plug when the communication plug and the corresponding communication outlet are mated, wherein the first and second projections are pressed against the sidewall of the corresponding communication outlet when the portion of the communication plug is received inside the receptacle of the corresponding communication outlet, the pressing exerting sufficient force on the first and second projections to overcome the biasing force and move the insulator to the second different one of the insulating position and the non-insulating position.

25. The communication plug of claim 21, further comprising:

a housing comprising an exit aperture, the housing being configured to house the substrate, the plurality of plug contacts, and at least a portion of the insulator, the at least one projection extending outwardly from inside the housing through the exit aperture.

26. The communication plug of claim 25 for use with a corresponding communication outlet configured to mate with the communication plug to form a connection therewith, the corresponding communication outlet comprising a sidewall defining a receptacle configured to receive a portion of the communication plug when the communication plug and the corresponding communication outlet are mated, wherein the at least one projection is pressed against the sidewall of the corresponding communication outlet when the portion of the communication plug is received inside the receptacle of the corresponding communication outlet, the pressing exerting sufficient force on the at least one projection to overcome the biasing force and move the insulator to the second different one of the insulating position and the non-insulating position.

27. The communication plug of claim 21, wherein the plurality of plug contacts and the plurality of circuit paths are configured to carry a plurality of differential signals at a data rate of up to about 40 Gigabits per second and an operating frequency of up to about 2 Gigahertz.

28. The communication plug of claim 21, wherein the plurality of plug contacts comprise a plurality of frame spades.

* * * * *